US009784253B2

(12) United States Patent
Cannata

(10) Patent No.: US 9,784,253 B2
(45) Date of Patent: Oct. 10, 2017

(54) VARIABLE DISPLACEMENT PISTON-IN-PISTON HYDRAULIC UNIT

(71) Applicant: Antonio Cannata, London (CA)

(72) Inventor: Antonio Cannata, London (CA)

(73) Assignee: Tonand Brakes Inc., London (CA)

( * ) Notice: Subject to any disclaimer, the term of this patent is extended or adjusted under 35 U.S.C. 154(b) by 427 days.

(21) Appl. No.: 14/448,439

(22) Filed: Jul. 31, 2014

(65) Prior Publication Data

US 2016/0032948 A1 Feb. 4, 2016

(51) Int. Cl.

| | |
|---|---|
| ***F15B 15/14*** | (2006.01) |
| ***F04B 3/00*** | (2006.01) |
| ***F04B 53/14*** | (2006.01) |
| ***F04B 53/16*** | (2006.01) |

(52) U.S. Cl.
CPC ..... *F04B 3/003* (2013.01); *F04B 53/14* (2013.01); *F04B 53/162* (2013.01)

(58) Field of Classification Search
CPC ..... F04B 49/16; F15B 3/00; F15B 15/1409
See application file for complete search history.

(56) References Cited

U.S. PATENT DOCUMENTS 1,997,456 A * 4/1935 Dickinson ..... F01D 17/18 415/40
1,997,476 A * 4/1935 Wallene ..... F04B 49/022 417/274
2,075,099 A * 3/1937 Dow ..... F04B 39/10 417/275
2,720,811 A * 10/1955 Sziklai ..... G01J 3/51 356/405
3,908,373 A * 9/1975 Peterson ..... F01B 11/00 417/402
4,502,844 A * 3/1985 Kimura ..... F04B 27/16 417/275
4,694,732 A * 9/1987 Kursar ..... F04B 49/16 92/60.5
4,696,158 A * 9/1987 DeFrancisco ..... F02G 3/02 60/39.62
5,167,292 A * 12/1992 Moiroux ..... B60K 6/12 138/31
6,945,062 B2 * 9/2005 Chen ..... F04B 49/16 417/274
2012/0222546 A1 * 9/2012 Cannata ..... F15B 1/24 92/81

FOREIGN PATENT DOCUMENTS

| | | | | |
|---|---|---|---|---|
| DE | 345142 C | * | 12/1921 | ..... F04B 25/02 |
| DE | 866711 C | * | 2/1953 | ..... F04B 25/00 |
| FR | 2720811 A1 | * | 12/1995 | ..... F04B 49/16 |

* cited by examiner

*Primary Examiner* — Thomas E Lazo
*Assistant Examiner* — Matthew Wiblin
(74) *Attorney, Agent, or Firm* — Grant Tisdall; Gowling WLG (Canada) LLP

(57) ABSTRACT

A piston-in-piston non-compressible unit is disclosed that utilizes an elastic volume to store and release energy with each stroke by varying the non-compressible fluid volumes in and out of the hydraulic unit.

9 Claims, 22 Drawing Sheets

VARIABLE DISPLACEMENT PISTON-IN-PISTON HYDRAULIC UNIT

TECHNICAL FIELD

The present disclosure relates to the field of hydraulic piston operated devices.

BACKGROUND

Traditional braking such as drum or disc braking systems have been widely used in a range of vehicle applications. However, brake fade caused when the drums or discs and the linings of the brakes overheat from excessive use become particularly problematic in large vehicle applications. Traditional braking systems usually require regular maintenance to service and replace consumable components, such as brake pads. Large vehicles such as locomotives, semi-trailer trucks, waste collection vehicles, construction vehicles and other large multi-axle vehicles require considerable braking power to adequately control braking, particularly when the vehicle is carrying a load. Reliability of braking systems can have significant implications in terms of safety and cost.

As an alternative to traditional friction resistance brakes, liquid resistance or direct hydraulic braking have been used which do not rely on friction to transmit braking force. However, these systems have been limited in application due to sizes required to achieve the desired braking efficiency and modulation capability. The use of a hydraulic pump in direct hydraulic braking, having a reciprocating piston, can require significant fluid displacement to achieve desired brake horse power (BHP). However, the relatively large displacement required to achieve high braking can impact the design of piston units, for example requiring larger sized units due to larger bores and/or increased stroke lengths, thus limiting their application.

SUMMARY

There is a need for a compact piston unit that provides improved hydraulic performance.

In one embodiment, the piston unit comprises a main block having a primary piston bore located there-through and having an axis extending lengthwise through the primary piston bore. A primary piston is operable to reciprocate within the primary piston bore along the axis. A secondary piston is configured to be received within the secondary piston bore, and operable to reciprocate therein along the axis of the channel. The primary piston defines a fluid cavity between a bottom surface of the secondary piston, a top surface of the primary piston and the opposing and adjacent surfaces of the primary piston bore. The primary piston and the secondary piston are operable to reciprocate along the axis relative to each other such that the primary piston is movable within the primary piston bore and the secondary piston is moveable within the secondary piston bore contrary to the movement of the primary piston, where the second piston bore is wider than and surrounds the primary piston bore. The piston unit also includes a head for encasing the primary piston and the secondary piston within the main block, thereby providing a gas cavity positioned between a top surface of the secondary piston and the head. The fluid cavity is fluidly connected to a fluid inlet and a fluid outlet for allowing fluid to enter and exit the fluid cavity, the fluid inlet and the fluid outlet positioned between a side wall of the primary piston bore and a side wall of the secondary piston bore.

According to another aspect of the present invention the secondary piston bore surrounds the primary piston bore defining a piston-in-piston configuration.

According to another aspect of the present invention the secondary piston moves within the secondary piston bore relative to pressure of fluid injected into the fluid cavity.

According to another aspect of the present invention the secondary piston further comprises a recessed piston seal around an outer circumference thereof to contain fluid in the fluid cavity and gas in the gas cavity.

According to another aspect of the present invention the movement of the primary piston is relative to the movement of an external surface interfacing with a lower surface of the primary piston. According to another aspect the movement of the primary piston is relative to the movement of an axle, the piston moving in relation to a mechanical actuator coupled to the axle.

A piston unit comprising a main block having a secondary piston bore located there-through and having an axis extending lengthwise through the secondary piston bore; a secondary piston operable to reciprocate within the secondary piston bore along the axis; a primary piston configured to be received within the primary piston bore, and operable to reciprocate therein along the axis, the primary piston comprising a upper piston portion and a piston lower portion configured to reciprocate along axis A, the upper piston portion and the lower piston portion fixed relative to one another by the length along axis A of a piston stem, the upper portion of the primary piston defining a fluid cavity between opposed and adjacent surfaces of the primary piston bore, a lower surface of the planar portion of the secondary piston and an upper surface of the upper piston portion of the primary piston, the lower portion of the primary piston defining a fluid cavity between an upper surface of the lower piston portion, opposed and opposite surfaces of the lower primary piston bore and an upper surface of the lower primary piston bore; the primary piston and the secondary piston operable to reciprocate along the axis relative to each other such that the primary piston is movable within the primary piston bore and the secondary piston is moveable within the secondary piston bore contrary to the movement of the primary piston; and the fluid cavity fluidly connected to a fluid inlet and a fluid outlet for allowing fluid to enter and exit the fluid cavity, the fluid inlet and the fluid outlet positioned between the primary piston bore and the secondary piston bore.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1A:
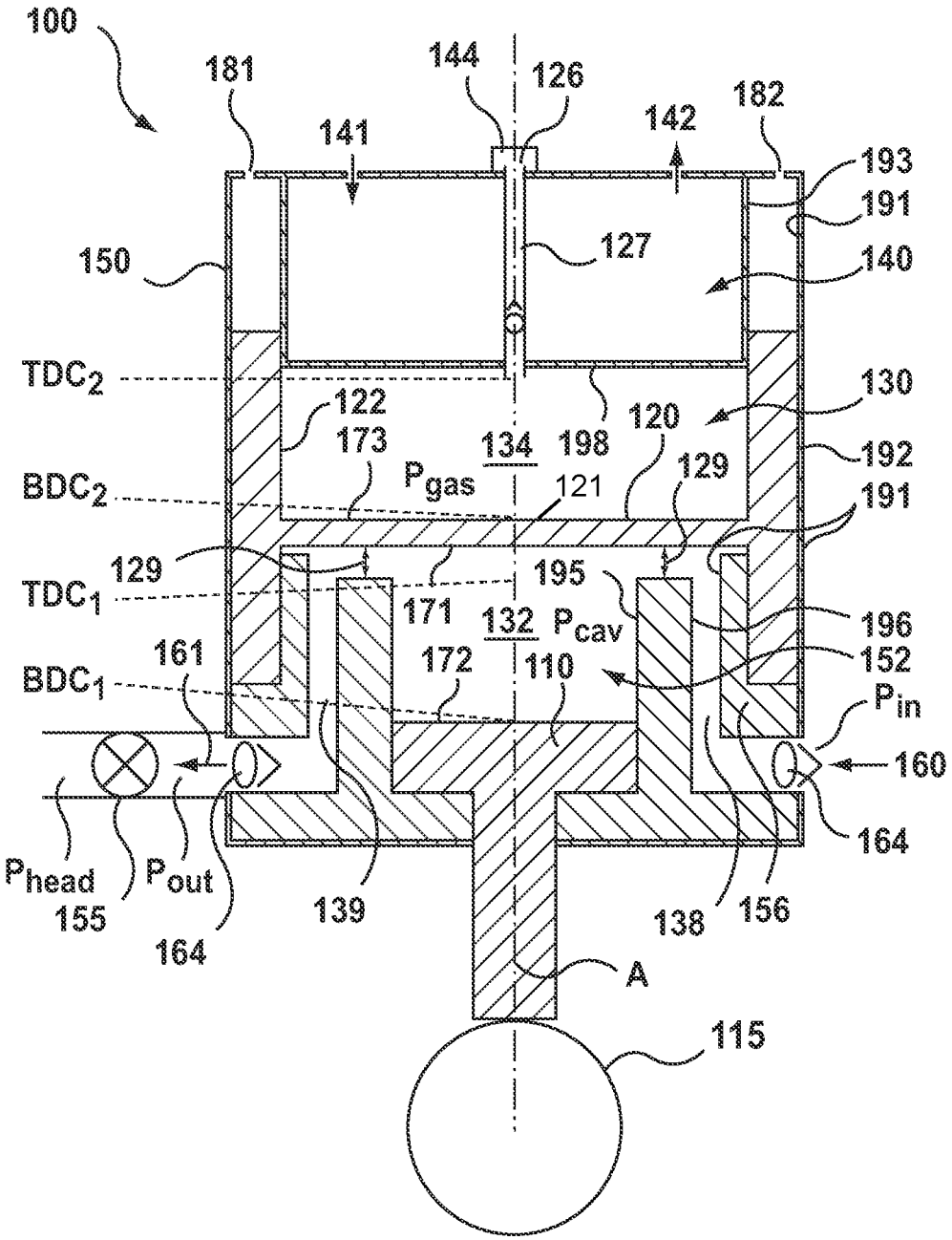
FIGS. 1A and 1B shows cross-sectional views of the assembled piston unit in a top dead centre (TDC) and bottom dead centre (BOG) configuration.

Embodiments are described below, by way of example only, with reference to FIGS. 1 to 8. The embodiments described and depicted herein provide a non-compressible fluid and compressible fluid piston-in-piston mechanism.

Described herein is a piston-in-piston unit that provides for the manipulation of a non-compressible fluid used for braking applications, through the use of variable displacement techniques of the non-compressible fluid as further described below. The piston-in-piston unit, described herein, provides a greater range of operation that would not be possible using a traditional piston unit. The interplay of a non-compressible fluid cavity formed between an alternating mechanical- and pressure-driven primary piston and a secondary piston with a gas cavity (containing compressed gas) formed between the secondary piston and a cylinder head, modulates the dynamics of the piston unit. The primary piston is mechanical and pressure driven in that it is mechanically-driven on the way to Top Dead Center (TDC) and pressure driven using a non-compressible fluid on the way to Bottom Dead Center (BDC). The interplay between the primary piston and the secondary piston facilitates an overall improvement in the performance of the piston unit by providing an elastic volume of a gas cavity that can store and release energy with each stroke by simultaneously varying the non-compressible fluid volume and the gas volume. It is also recognised that the volume of the gas cavity can remain relatively constant under certain operating conditions. The ability for the volume of the gas cavity to remain constant, or to change, facilitates an advantageous variable displacement operation of the piston unit, as further described below. It is recognised that power of the piston unit, described herein, is a function of the product of the flow of non-compressible fluid (i.e. volume per unit time) and the pressure differential between the input non-compressible fluid and the output non-compressible fluid.

In general, the piston unit comprises a primary piston and a secondary piston, the primary piston actuating within a bore formed by or within the secondary piston. One advantage of the piston unit is that the amount of non-compressible fluid that can be injected and/or ejected with respect to the piston unit can be varied dynamically based on the injection pressure of the non-compressible fluid and/or the gas pressure inside of the gas cavity. This is facilitated by a secondary gas cavity that contains gas which is compressed or expanded (i.e. as influenced by the changing volume of the gas cavity) during piston unit operation, providing the variable displacement capability of the piston unit. It is noted that the non-compressible fluid can be any fluid that does not compress, including but not limited to hydraulic fluid, oil and/or coolant.

The primary piston of the piston unit can interface with a mechanical receiving member, such as a cam coupled to a drive shaft, to apply or deliver power, such as in a braking operation. It will be understood that the piston unit, described herein, is not limited to interaction with a cam and can couple with other receiving members known to a person skilled in the art, such as known crank shaft and connecting rod arrangements. However, for the purposes of the embodiments described herein, reference will be made to the receiving member being a cam. The piston unit can also be used in combination with multiple piston units to provide controlled deceleration.

Piston Unit

Turning to the Figures, the piston unit 100 is described in further detail. FIG. 1 shows a cross-section view of the main components of the piston unit 100. The piston unit 100 comprises a primary piston 110 and a secondary piston 120. The primary piston 110 is received within a primary piston bore 152. The primary piston bore has an inner surface 195 and an outer surface 196. The primary piston bore 152 and the primary piston 110 are configured and sized to allow for reciprocal movement of the primary piston 110 within the primary piston bore 152.

It will be understood that the terms "top" and "bottom" referred to herein are used in the context of the attached Figures. The terms are not necessarily reflective of the orientation of the piston unit 100 in actual use and are therefore not meant to be limiting in their use herein.

The secondary piston 120 is received within a secondary piston bore 130 that has a cross-sectional width greater than primary piston bore 152 and is configured to receive the secondary piston 120 therein. The secondary piston bore has an inner surface 191 on portion 156 and an outer surface 192. The secondary piston 120 is operable to reciprocate within the secondary piston bore 130 relative to the primary piston 110, as facilitated by a pressure differential between the pressure of the non-compressible fluid in the fluid cavity 132 and the pressure of the compressible gas in gas cavity 134. It is noted that the secondary piston 120 is operable to move (e.g. reciprocate) within the secondary piston bore 130 independently of the position of the primary piston 110 in the primary piston bore 152, or dictated by differential pressures in the cavities 132,134. For, example, if the pressure in fluid cavity 132 is greater than the pressure in gas cavity 134, than the secondary piston 120 will move up with respect to the primary piston 110 regardless of the movement of the primary piston (see arrow 129 in FIG. 2A). Similarly, the pressure in fluid cavity 132 is less than the pressure in gas cavity 134, the secondary piston 120 will move down with respect to the primary piston 110 regardless of the movement of the primary piston (see arrow 129 in FIG. 1A). Finally, if the pressure in the fluid cavity 132 is equal to the pressure in the gas cavity 134, the secondary piston 120 will remain stationary regardless of the movement of the primary piston 110. Primary piston 110 and secondary piston 120 can also move simultaneously, as discussed below in the description of the operation of the piston unit 100.

Secondary piston 120 comprises a piston wall 122 and a planar portion 121. Although the secondary piston bore 130 and secondary piston 120 are shown to be cylindrical in shape, other shapes can be contemplated provided that the contour of the secondary piston 120 is similar to the contour of the secondary piston bore 130. Other configurations can therefore be utilized while operating in a similar manner as described herein.

Movement and associated position of the primary piston 110 and the secondary piston 120 within the primary piston bore 152 and the secondary piston bore 130, respectively, affects the size (i.e. volume) of the fluid cavity 132. Movement and associated position of the secondary piston 120 relative to the primary piston 110 will also affect the size (i.e. volume) of the gas cavity 134. This change in size, or volume, will be described further below in the description of the operation of the piston unit 100.

As can be seen in FIG. 1, an axis A runs lengthwise through the primary piston bore 152 and the secondary piston bore 130. Movement of the secondary piston 120 and the primary piston 110 relative to each other, and relative to the primary piston bore 152 and the secondary piston bore 130, can be along this axis A. It is recognised that, shown by example, both the primary piston 110 and secondary piston 120 are concentric about the axis A. However, it is recognised that the primary piston 110 and the secondary piston 120 can be non-concentric about the axis A, as desired.

When the primary piston 110 is at BDC, as shown in FIG. 1A, the fluid cavity 132 is defined by opposed and adjacent surfaces of the primary piston bore 152, the lower surface 171 of the planar portion 121 of the secondary piston 120 and the upper surface 172 of the primary piston 110. When the primary piston is at TDC, the fluid cavity 132 is defined by opposed and adjacent surfaces of the secondary piston wall 122, the lower surface 171 of the planar portion 121 of the secondary piston 120 and the upper surface 173 of the primary piston 110. The fluid cavity 132 therefore has a variable cavity volume for the non-compressible fluid which can vary depending upon the position of the primary piston 110 and secondary piston 120 along the axis A during operation of the piston unit 100.

Figure 1B:
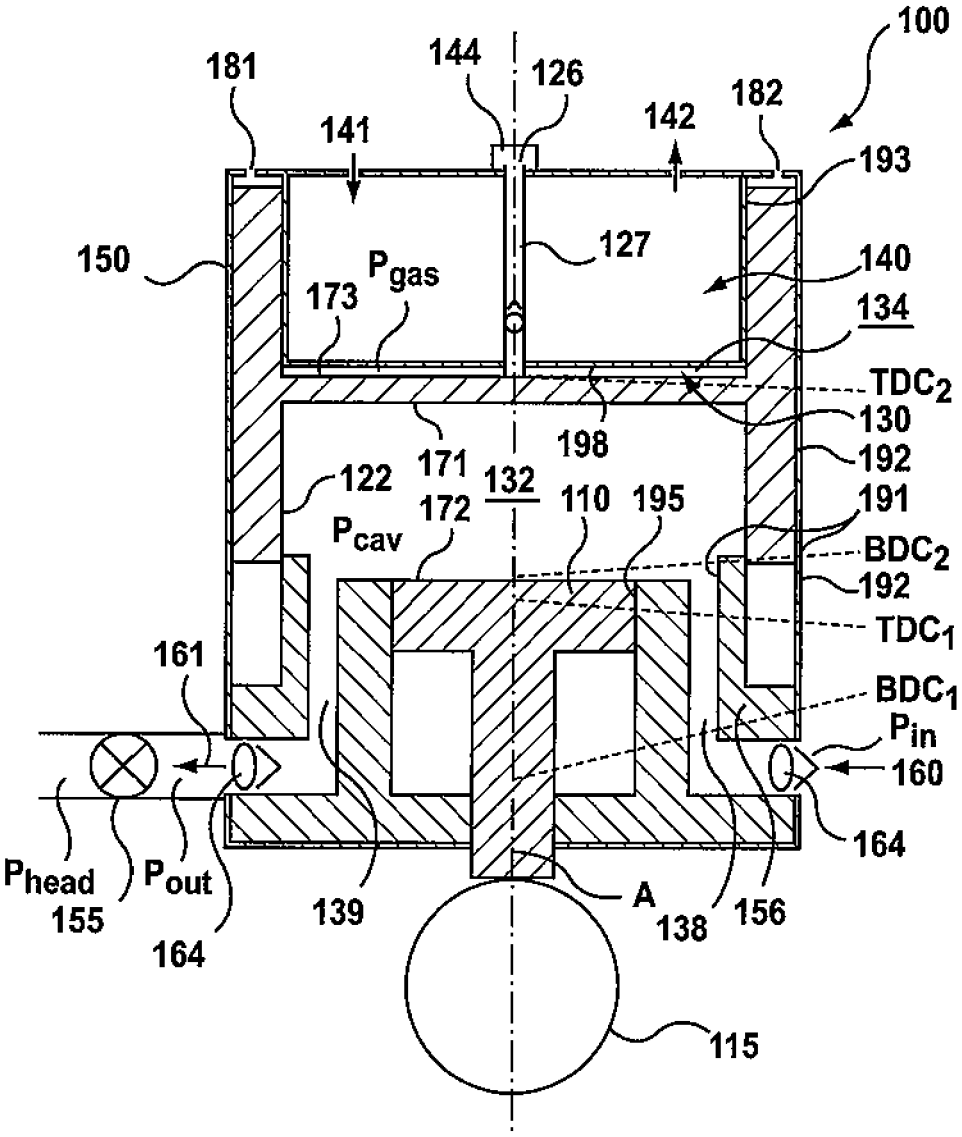

The gas cavity 134 is defined by opposed and adjacent surfaces of the piston wall 122 of secondary piston 120, the upper surface 173 of planar portion 121 of secondary piston 120 and the lower surface 198 of cylinder head 140 when it is at both TDC and BDC, as shown in FIGS. 1A and 1B. The gas cavity 134 is configured to contain a compressible gas. The gas cavity 134 defines a variable cavity volume for a compressible gas which varies depending upon the position of secondary piston 120 and the pressure in the fluid cavity 132 along the axis A during operation, of the piston unit 100.

A cylinder head 140 is located at the end of the secondary piston bore 130 opposite from the primary piston 110 and is secured to a main block 150. The cylinder head 140 includes a cylinder head coolant inlet port 141 and a cylinder head coolant outlet port 142. These ports allow coolant fluid to flow through the cylinder head, removing heat from piston unit 100 generated by the operation of primary piston 110 and secondary piston 120 and the compression of the compressible fluid in the gas cavity 134.

A gas inlet guide cap 144, which includes a gas inlet 126, is coupled to the cylinder head 140. The gas inlet guide cap 144 fluidly connects the gas inlet 126 with the gas passageway 127. The gas passageway 127 can be in line with the vertical axis of the secondary piston 120. Compressible gas, such as air, nitrogen or an inert mixture of gases, for example, are input or output through gas inlet 126 into gas passageway 127 of cylinder head 140 and subsequently into a gas cavity 134, described further below. It is recognised that the gas pressure $P_{gas}$ of the gas in the gas cavity 134 can be influenced by the injection and or ejection of a measured amount of gas, through the gas passageway 127, along with the relative position along axis A between the primary piston 110 and secondary piston 120 and have the resulting volume of the gas cavity 134 due to the relative position.

The main block 150 can also comprise upper skirt breathing tubes 181 and 182, which may be used to inhibit a vacuum from forming in the secondary bore 130 as defined by opposing surfaces 191 and 193 of the main block 150 and the cylinder head 140 within which the secondary piston 120 is operable to move.

The main block 150 includes a fluid, inlet 160 and a fluid outlet 161, which are in fluid communication with the fluid cavity 132 through a fluid inlet gallery 138. The fluid inlet 160 and the fluid outlet 161 can contain fluid check valves for coordinating the injection and ejection of the non-compressible fluid to and from the fluid cavity 132, based on injection pressure $P_{in}$ of the non-compressible fluid at inlet 160, ejection pressure $P_{out}$ of the non-compressible fluid at outlet 161 and cavity pressure $P_{cav}$ of the non-compressible fluid within the fluid cavity 132. Non-compressible fluid is therefore able to pass between the fluid inlet 160 and fluid outlet 161 and through the fluid cavity 132, depending on inlet pressure $P_{in}$ of the non-compressible fluid and outlet pressure $P_{out}$ of non-compressible fluid, as influenced by operation of the primary piston 110 and secondary piston 120 (i.e. affecting cavity pressure $P_{cav}$ of the non-compressible fluid). It should be noted that the pressure of the non-compressible fluid in the fluid line adjacent to the outlet 161 is controlled by a pressure control valve 155. An example setting of the pressure control valve 155 is 5000 psi.

Fluid inlet 160 is in fluid communication with fluid cavity 132 through fluid inlet gallery 138. Fluid inlet gallery 138 carries non-compressible fluid from the fluid inlet 160 between the primary piston 110 and the secondary piston bore 130 when check valve 164 is open. Fluid inlet gallery 138 carries fluid between the outer surface 196 of primary piston bore 152 and the inner surface 191 of the secondary piston bore 130. Fluid inlet gallery 138 fluidly connects with fluid cavity 132 at the top of the primary piston bore 152, above TDC of primary piston 110. This configuration allows the non-compressible fluid entering the piston unit 100 to enter in a manner that does not impede or restrict the operation of either the primary piston 110 or the secondary piston 120. The non-compressible fluid is able to pass between the primary piston 110 and the secondary piston 120 without interrupting the interaction of either piston as they operate between their respective TDC and BDC. This configuration also allows gas cavity 134 to be defined by an uninterrupted space.

Fluid outlet 161 is in fluid communication with fluid cavity 132 through fluid outlet gallery 139. Fluid outlet gallery 139 carries non-compressible fluid from the fluid cavity 132 between the primary piston 110 and the secondary piston 120 when check valve 165 is open. Fluid outlet gallery 139 carries fluid between the outer surface 196 of primary piston bore 152 and the inner surface 191 of the secondary piston bore 130. Fluid outlet gallery 139 fluidly connects with fluid cavity 132 at the top of the primary piston bore 152, above TDC of primary piston 110. This configuration allows the non-compressible fluid exiting the piston unit 100 to do so in a manner that does not impede or restrict the operation of either the primary piston 110 or the secondary piston 120. The non-compressible fluid is able to pass between the primary piston 110 and the secondary piston 120 without interrupting the interaction of either piston as they operate between TDC and BDC. This configuration also allows gas cavity 134 to be defined by an uninterrupted space.

As fluid inlet gallery 138, fluid outlet gallery 139 and fluid cavity 132 are all in fluid communication with each other, without interruption by valves or the like, the pressure in these three areas is always equal. Therefore, as the pressure increases in the fluid cavity 132 in response to a decreasing volume caused by the movement of either the primary piston 110 or the secondary piston 120, the pressures in the fluid inlet and fluid outlet galleries, 138 and 139, respectively, equalizes with the pressure change in the fluid cavity 132.

Although one embodiment of the main block 150 previously described includes a non-compressible fluid inlet port 160 and a non-compressible fluid outlet port 161 which are in fluid communication with the fluid cavity 132, it will be understood that multiple inlets/outlets 160, 161 can be provided in varying orientations.

The assembled piston unit 100 includes the main block 150, coupled to the cylinder head 140 with gas inlet guide cap 144 extending therefrom. Although the main block 150 is shown to be relatively rectangular in cross-sectional shape with respect to the axis A, the main block 150 can be tailored to fit any required application or can be manufactured as part of a larger block containing multiple head and piston assemblies in varying configurations. As discussed further below, an upper piston portion 112 of the primary piston 110 can be operable to extend below the lower end of the main block, also referred to as BDC, so as to provide space for interaction of the primary piston 110 with mechanical actuation thereof via a cam or other form of mechanical actuation 115.

The volumes of the fluid cavity 132 and the gas cavity 134 are defined by the relative position of the primary piston 110 during movement between BDC and TDC, the relative position of the secondary piston 120 within the primary piston 110 (i.e. within secondary piston bore 130), and the injection pressures $P_{cav}$, $P_{gas}$ of the fluid and gas. In use, the injection pressure $P_{in}$ of the non-compressible fluid injected into the fluid cavity 132 can affect the pressure exerted on the gas cavity 134 by the pistons 110, 120. In use, the ejection pressure $P_{out}$ of the non-compressible fluid ejected out of the fluid cavity 132 can affect the pressure exerted on the gas cavity 134 by the primary piston 110 and secondary piston 120 and the mechanical actuation 115 (e.g. cam).

Gas is initially provided through gas inlet 126 to gas passageway 127 entering the gas cavity 134 through a check valve 128. The compressed gas in the gas cavity 134 facilitates the operation of the gas cavity 134 as an elastic volume which is able to store and release energy with each stroke of the primary piston 110. In other words, as the gas cavity 134 changes in volume due to the influence of mechanical actuation experienced by the primary piston 110 and the non-compressible fluid pressure $P_{cav}$ in the fluid cavity 132, the pressure in $P_{gas}$ increases fluctuates. Variable displacement is therefore performed by the piston unit 100 by varying injection pressure $P_{in}$, for example.

The secondary piston 120 includes a piston seal (not shown) to trap gas within the gas cavity 134 to inhibit bleed through into the non-compressible fluid cavity 132. The primary piston 110 can include one or more wear rings (not shown) to minimise wear of the external surface of the primary piston 110 as it moves within the primary piston bore 152, and/or to minimize potential wear of the inside wall/lining of the primary piston bore 152.

In an alternative embodiment shown in FIG. 2, the piston unit 200 comprises primary piston 110 which in turn comprises an upper piston portion 112 and a lower piston portion 114 connected by piston stem 116. The upper piston portion 112 of primary piston 110 is positioned and able to reciprocate in the upper primary piston bore 153 between TDC and BDC as further described below. Lower piston portion 114 is positioned and able to reciprocate in lower primary piston bore 154 between TDC and BDC as further described below. The positions of upper piston portion 112 and lower piston portion 114 along axis A are fixed relative to one another by the length along axis A of piston stem 116.

Lower piston portion 114 has a wider cross-sectional width in relation to axis A than upper piston portion 112. This difference in cross-sectional width in relation to axis A makes it possible for lower piston portion 114 to block the flow of the non-compressible fluid into the fluid cavity 133 when primary piston 110 is in the TDC position.

In this alternate embodiment, the primary piston 110 is received within an upper primary piston bore 153 and a lower primary piston bore 154. The upper primary piston bore 153 and the primary piston 110 are configured and sized to allow for reciprocal movement of the primary piston 110 within the upper primary piston bore 153. Similarly, the lower primary piston bore 154 and the primary piston 110 are configured and sized to allow for reciprocal movement of the primary piston 110 within the lower primary piston bore 154.

Figure 2A:
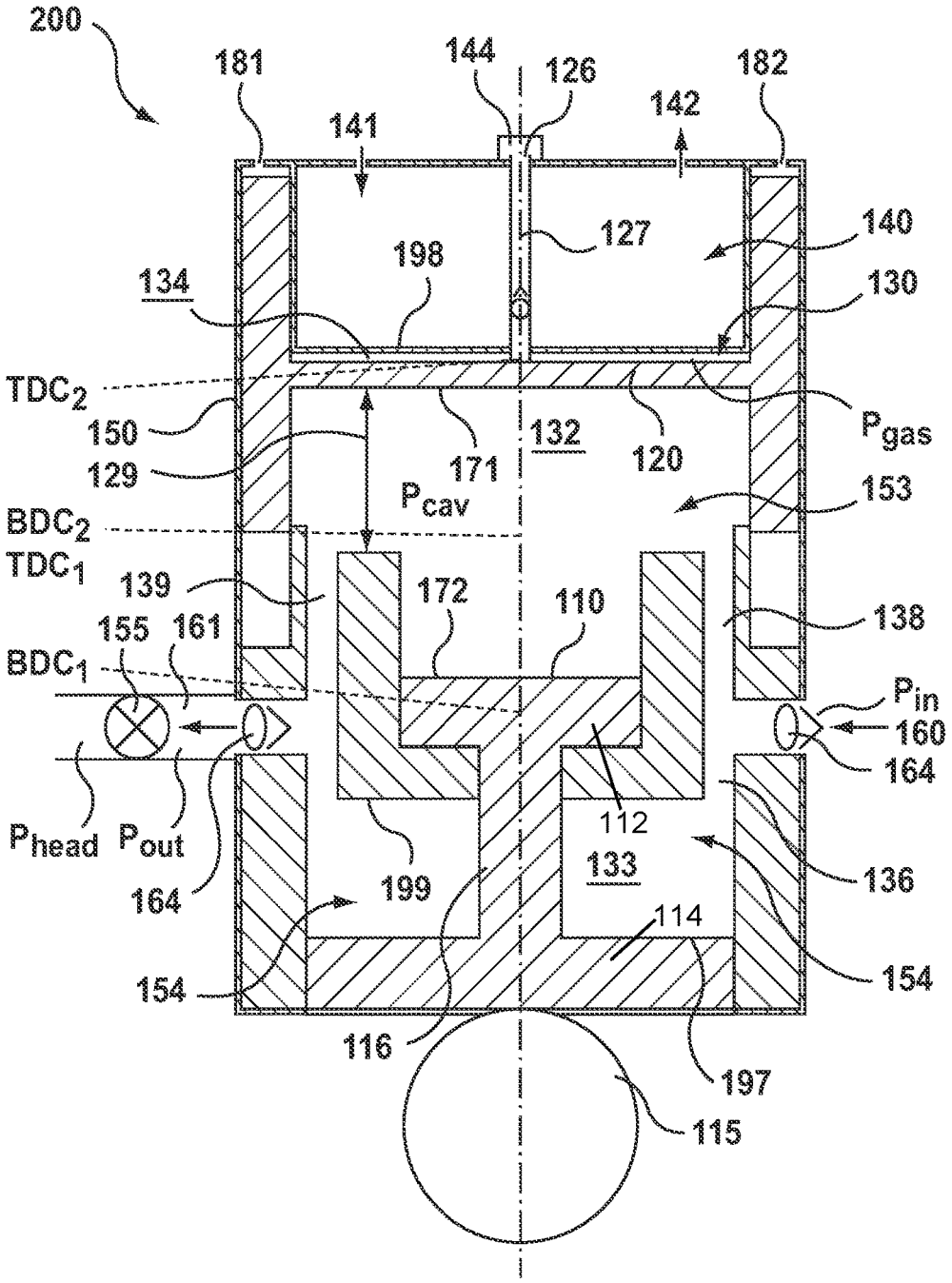
FIGS. 2A and 2B shows a cross-sectional view of an alternate embodiment of the assembled piston unit in a top dead centre (TDC) and bottom dead centre (BDC) configuration.

In this alternative embodiment, when the primary piston is at BDC (as shown in FIG. 2A), the fluid cavity 132 is defined by opposed and adjacent surfaces of the primary piston bore 152, the lower surface 171 of the planar portion 121 of the secondary piston 120 and the upper surface 172 of the upper piston portion 112 of the primary piston 110. When the primary piston is at BDG, a second fluid cavity 133 is defined by an upper surface 197 of the lower piston portion 114, opposed and opposite surfaces of the lower primary piston bore 154 and an upper surface 199 of the lower primary piston bore 154. Lower fluid cavity 133 has an interrupted volume cause by the presence of the stem therein.

Figure 2B:
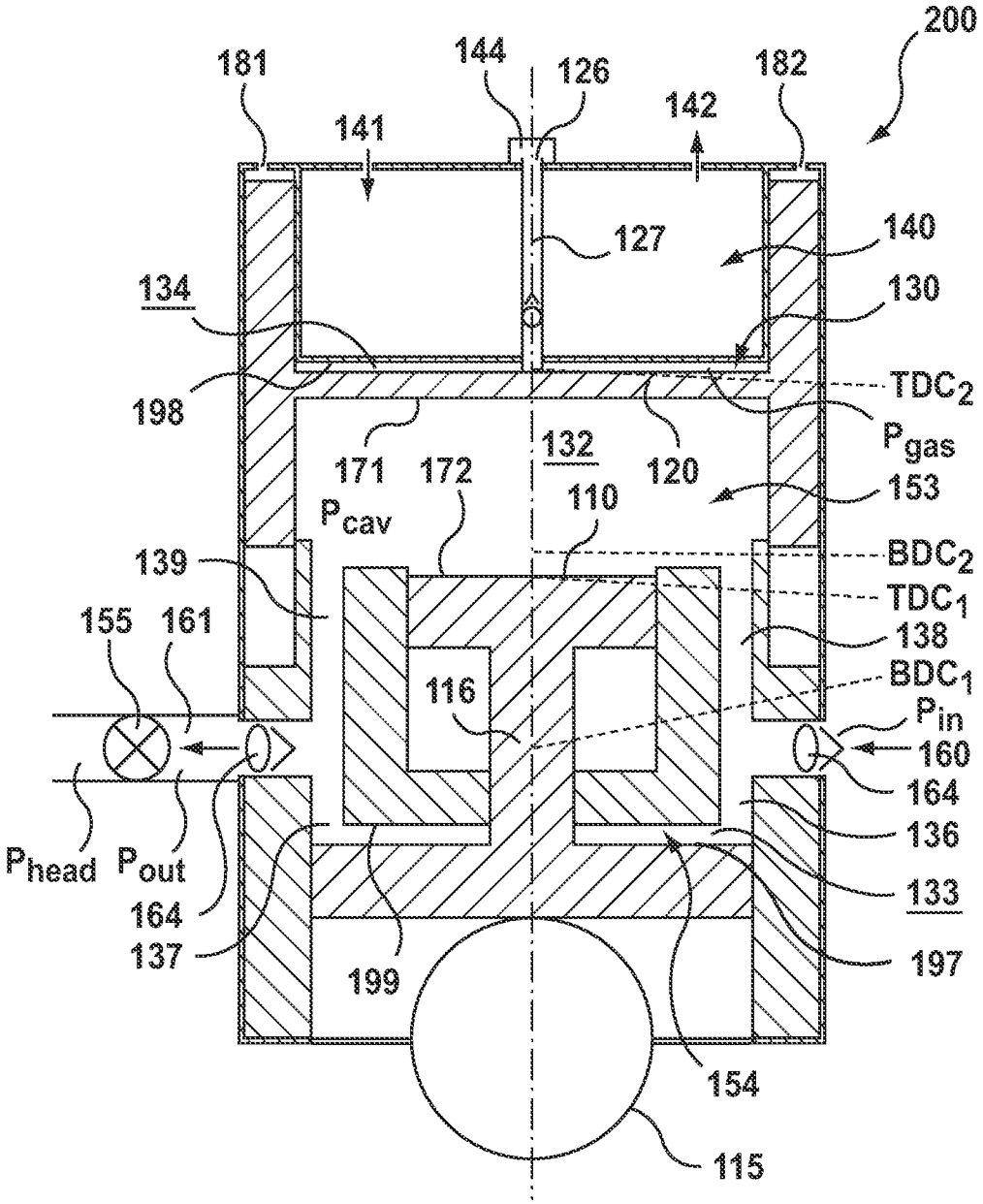

When the primary piston is at TDC, as shown in FIG. 2B, the fluid cavity 132 is, defined by opposed and adjacent surfaces of the secondary piston bore 150, the lower surface 171 of the planar portion 121 of the secondary piston 120 and the upper surface 172 of the upper piston portion 112 of the primary piston 110. When the primary piston is at TDC, the fluid cavity 134 is defined by the upper surface 197 of the lower piston portion 114, opposed and opposite surfaces of the lower primary piston bore 154 and the upper surface 199 of the lower primary piston bore 154. The fluid cavities 132, 134 therefore has a variable cavity volume for the non-compressible fluid which can vary depending upon the position of the primary piston 110 and secondary piston 120 along the axis A during operation of the piston unit 100.

The secondary piston 120 may move with respect to the primary piston 110 regardless of the movement of the primary piston 110. Fluid cavities 132 and 133 are fluidly connected and therefore have a constant pressure with respect to one another. Put another way, $P_{cav}$ is the pressure in both fluid cavity 132 and 133.

In use, the lower piston portion 114 is operable to contact a cam or other mechanical actuation mechanism 115 that is coupled to an axle or drive shaft of a vehicle (not shown). The movement of the primary piston 110 within the upper and lower primary piston bores 152 and 150 is driven by the movement of the 115 through the contact between the lower piston portion 114 and the cam 115. It is recognised that for simplicity, the cam 115 is but one example of mechanical actuation as used herein.

In this alternate embodiment, the remaining configuration of the secondary piston 120 and the gas cavity 134 may remain as described above.

In this alternate embodiment, the main block 150 includes a fluid inlet 160 and a fluid outlet 161, which are in fluid communication with the fluid cavities 132, 133. The fluid inlet 160 and the fluid outlet 161 may contain fluid check valves 164 and 165, respectively for coordinating the injection and ejection of the non-compressible fluid from the fluid cavities 132, 133, based on injection pressure $P_{in}$ of the non-compressible fluid, ejection pressure $P_{out}$ of the non-compressible fluid and cavity pressure $P_{cav}$ of the non-compressible fluid within the fluid cavities 132, 133. Non-compressible fluid is therefore able to pass between the fluid inlet 160 and fluid outlet 161, through the fluid cavities 132, 133 depending on inlet pressure $P_{out}$ of the non-compressible fluid and outlet pressure $P_{out}$ of non-compressible fluid as influenced by operation of the pistons 110,120 (i.e. affecting cavity pressure $P_{cav}$ of the non-compressible fluid). It should be noted that the pressure of the non-compressible fluid in the fluid line adjacent to the outlet 161 is controlled by a pressure control valve (not shown). An example setting of the pressure control valve is 5000 psi.

Fluid inlet 160 separates into two distinct fluid inlet galleries, upper fluid inlet gallery 138 and lower fluid inlet gallery 136. Upper fluid inlet gallery 138 carries non-compressible fluid from the fluid inlet 160 between the fluid cavity 132 and the secondary piston bore 130 when check valve 164 is open. Lower fluid inlet gallery 136 carries non-compressible fluid from the fluid inlet 160 to the lower fluid cavity 133. Lower fluid inlet gallery 136 delivers the non-compressible fluid into the top of the fluid cavity 134 so as to not interfere operation of the lower piston portion 114 of primary piston 110. Also, in this configuration, the non-compressible fluid may be delivered to the lower primary piston bore 154 during a complete stroke of the piston from TDC to BDC. Also, in this configuration, the non-compressible fluid may enter the piston unit 100 via fluid inlet 160 and be delivered to the upper and lower fluid cavities 132 and 133 simultaneously. This provides that the pressures in the fluidly connected fluid cavities 132 and 134 will remain constant as the non-compressible fluid is injected into the piston unit 100.

Fluid outlet 161 is fed by two distinct fluid outlet galleries, upper fluid outlet gallery 139 and lower fluid outlet gallery 137. Upper fluid outlet gallery 139 carries non-compressible fluid from the fluid cavity 132 to the fluid outlet 161 by passing between the primary piston 110 and the secondary piston 120 when check valve 165 is open. Lower fluid outlet gallery 137 carries non-compressible fluid from the fluid cavity 133 to fluid outlet 161. Lower fluid outlet gallery 137 carries the non-compressible fluid out of the top of the fluid cavity 134 so as to not interfere operation of the lower piston portion 114 of primary piston 110. Also, in this configuration, the non-compressible fluid may be carried out of the lower primary piston bore 154 during a complete stroke of the piston from TDC to BDC. Also, in this configuration, the non-compressible fluid may be ejected from the upper and lower fluid cavities 132 and 133 of the piston unit 100 via fluid outlet 161 simultaneously. This provides that the pressures in the fluidly connected fluid cavities 132 and 134 will remain constant as the non-compressible fluid is ejected from the piston unit 100.

Operation

Three examples of the operation of the piston unit 100 will now be described. In these examples, the $P_{in}$, $P_{out}$, $P_{cav}$, $P_{gas}$ are described and shown on the respective Figures. In all examples an assumption is made that the piston unit works into a head of $P_{head}$, i.e. fluid resistance in the non-compressible line (not shown coupled to the fluid outlet 161 is configured at $P_{head}$ using a control valve 155 (e.g. a fixed or variable sized orifice) located in the non-compressible line.

In the following examples, it is understood that a complete stroke of the piston unit comprises one downstroke and one upstroke. A downstroke comprises the movement of the primary piston from the TDC position to the BDC position, while a corresponding upstroke comprises the movement of the primary piston from the BDC position to the TDC position.

Non-Compressible Fluid Injection Phase

In FIG. 3 a non-compressible fluid injection phase is shown. For the purposes of this description an assumption is made that an initial air charge of $P_{gas}$ is provided through the gas inlet stem 124 and is trapped within the gas cavity 134.

During operation, fluid inlet 160 delivers fluid to fluid cavity 132 through fluid inlet gallery 138. Fluid inlet gallery 138 carries non-compressible fluid from the fluid inlet 160 between the primary piston 110 and the secondary piston bore 130 when check valve 164 is open. Fluid inlet gallery 138 carries fluid between the outer surface 196 of primary piston bore 152 and the inner surface 191 of the secondary piston bore 130. Fluid inlet gallery 138 fluidly connects with fluid cavity 132 at the top of the primary piston bore 152, above TDC of primary piston 110.

Similarly, during operation, non-compressible fluid exits fluid cavity 132 through fluid outlet gallery 139 and fluid outlet 161. Fluid outlet gallery 139 carries non-compressible fluid from the fluid cavity 132 between the primary piston 110 and the secondary piston 120 when check valve 165 is open. Fluid outlet gallery 139 carries fluid between the outer surface 196 of primary piston bore 152 and the inner surface 191 of the secondary piston bore 130. Fluid outlet gallery 139 fluidly connects with fluid cavity 132 at the top of the primary piston bore 152, above TDC of primary piston 110.

Figure 3A:
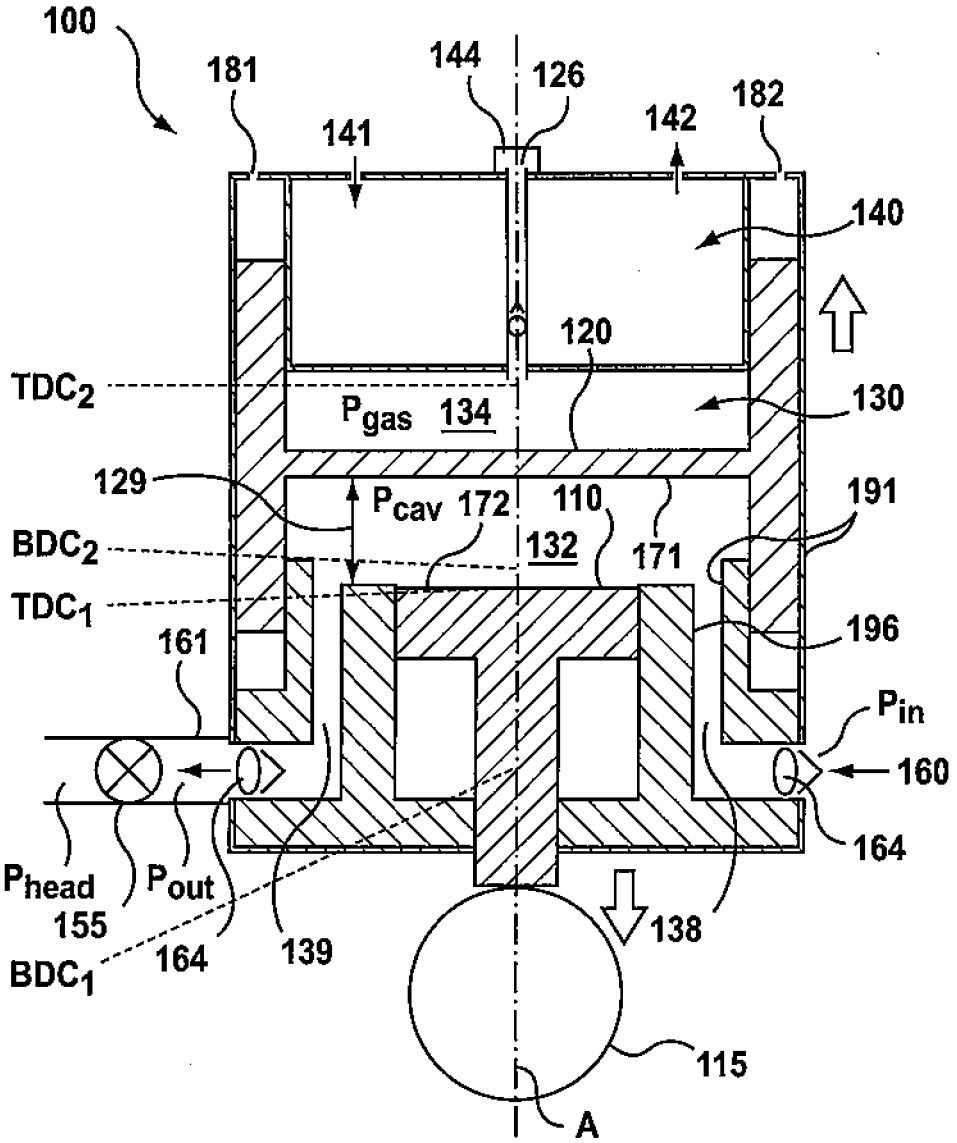
FIGS. 3A to 3C are schematic diagrams showing the non-compressible fluid injection phase for one embodiment of the assembled piston unit described herein.

As primary piston 110 commences a down-stroke from TDC in response to mechanical actuation by the cam 115, as shown in FIG. 3A, injection pressure opens the fluid inlet 160 and non-compressible fluid is injected through fluid inlet 160. If $P_{in}=P_{gas}$, fluid fills the non-compressible fluid cavity 132 that is increasing in size due to the receding primary piston 110 without displacing the secondary piston 120 due to the counter balance of the gas (P) in the gas cavity 134.

Figure 3B:
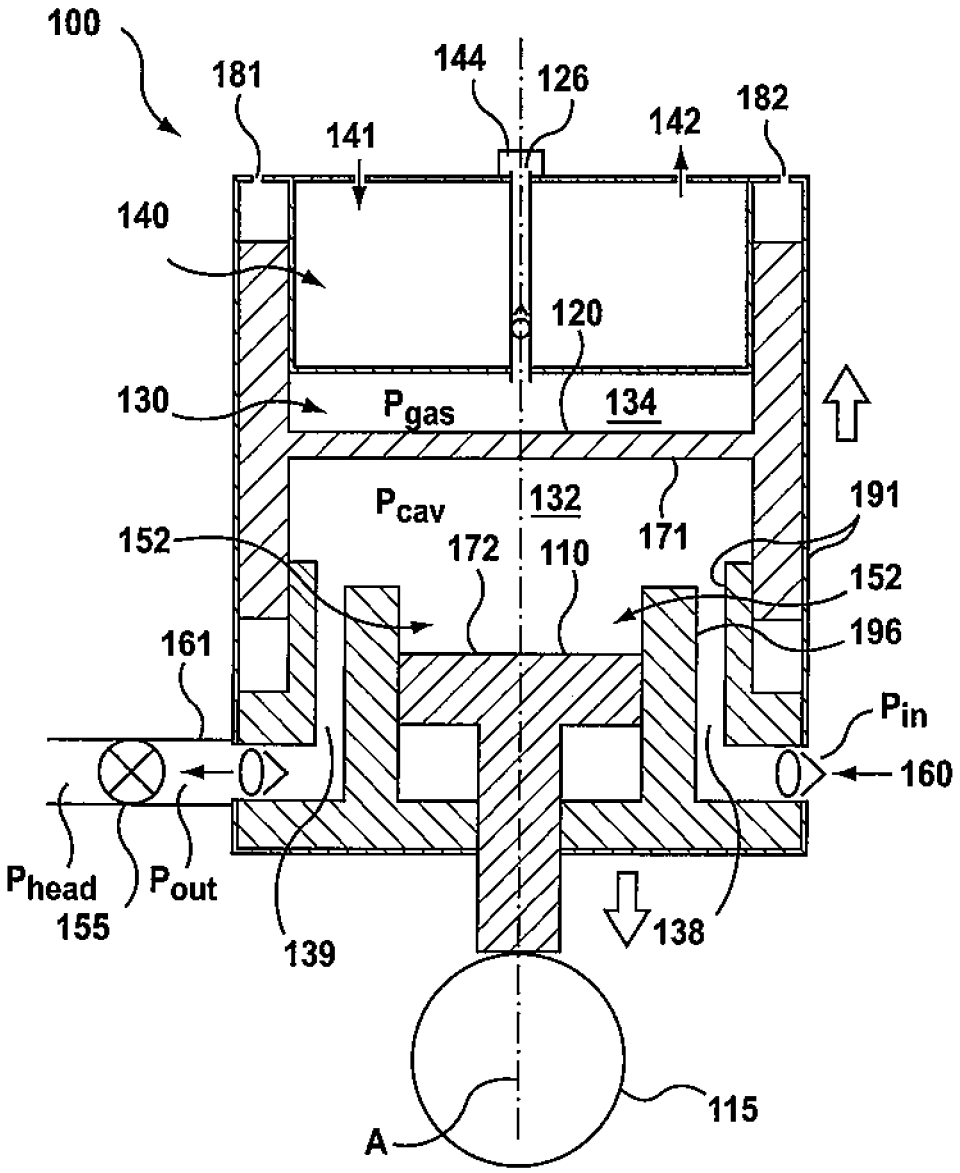

FIG. 3B shows a fluid injection pressure $P_{in}>P_{gas}$. When non-compressible fluid is injected at this pressure, the pressure in the fluid cavity 132 overcomes $P_{gas}$ and moves the secondary piston 120 upward and away from the primary piston 110, compressing the gas in the gas cavity 134 such that $P_{cav}=P_{gas}$. As the secondary piston 120 moves upward, the primary piston 110 descends within primary piston bore 152 which creates an increased volume in the fluid cavity 132 as secondary piston 120 and primary piston 110 are moving in opposite directions with respect to one another.

Figure 3C:
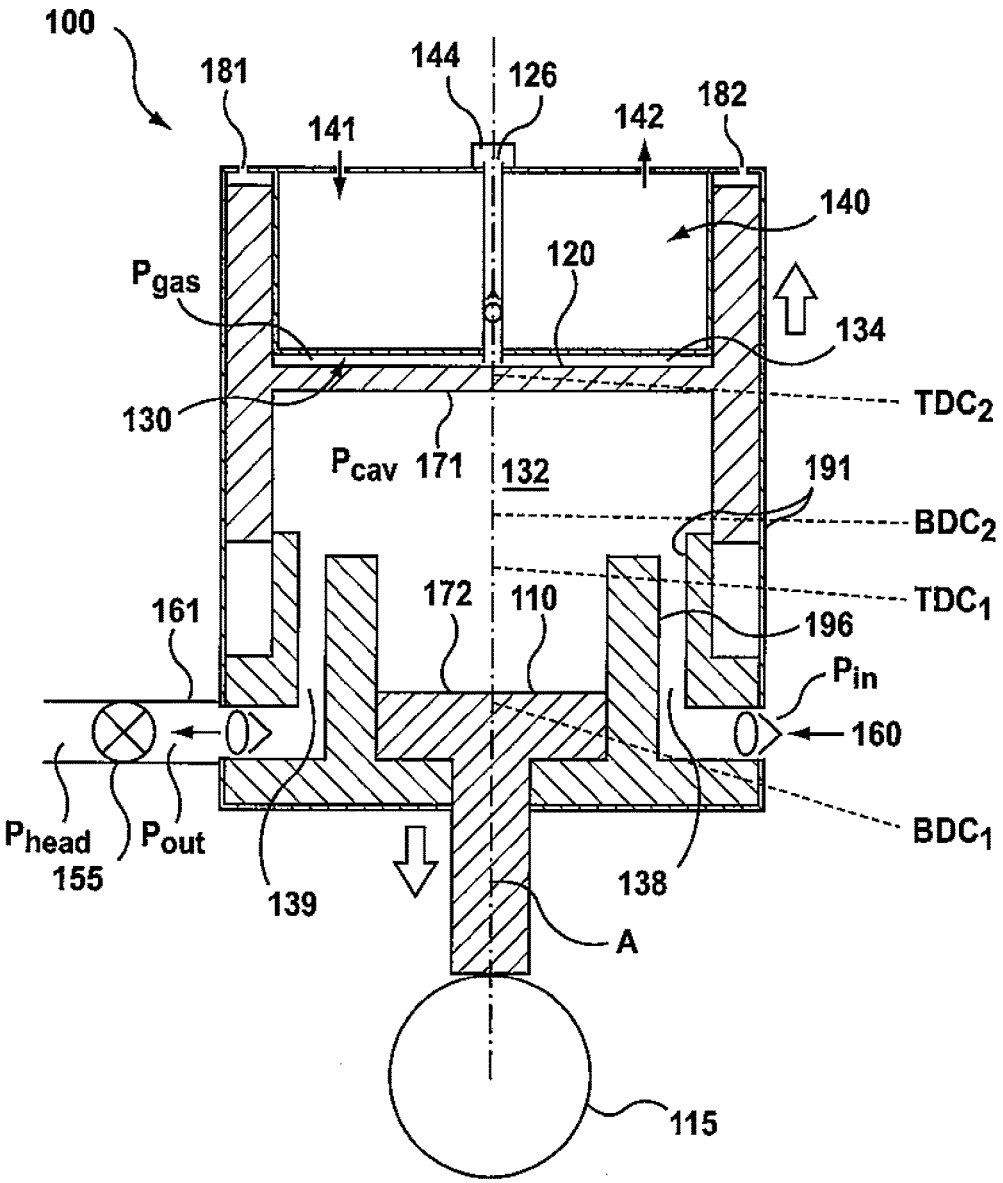

FIG. 3C shows an injection pressure of $P_{cav}>>P_{gas}$. As the non-compressible fluid is injected into fluid cavity 132, the pressure of the non-compressible fluid moves the secondary piston 120 away from the primary piston 110 towards the end of the secondary piston bore 130, reducing the size of gas cavity 134 and compressing the air in gas cavity 134.

This allows additional non-compressible fluid to be injected into fluid cavity 132. When the primary piston 110 reaches BDC, as shown in FIG. 3C, the secondary piston 120 is now towards the top of the secondary piston bore 130 and the pressures $P_{cav}$, $P_{gas}$ are still substantially equal on both sides.

As can be seen from FIGS. 3A to 3C the total volume of non-compressible fluid that can be injected into the fluid cavity 132 is a function of the initial injection pressure, $P_{in}$. The higher the injection pressure $P_{in}$, the larger the volume of non-compressible fluid that can be injected into the piston unit 100.

Non-Compressible Fluid Ejection Phase—Low Pressure

Figure 4A:
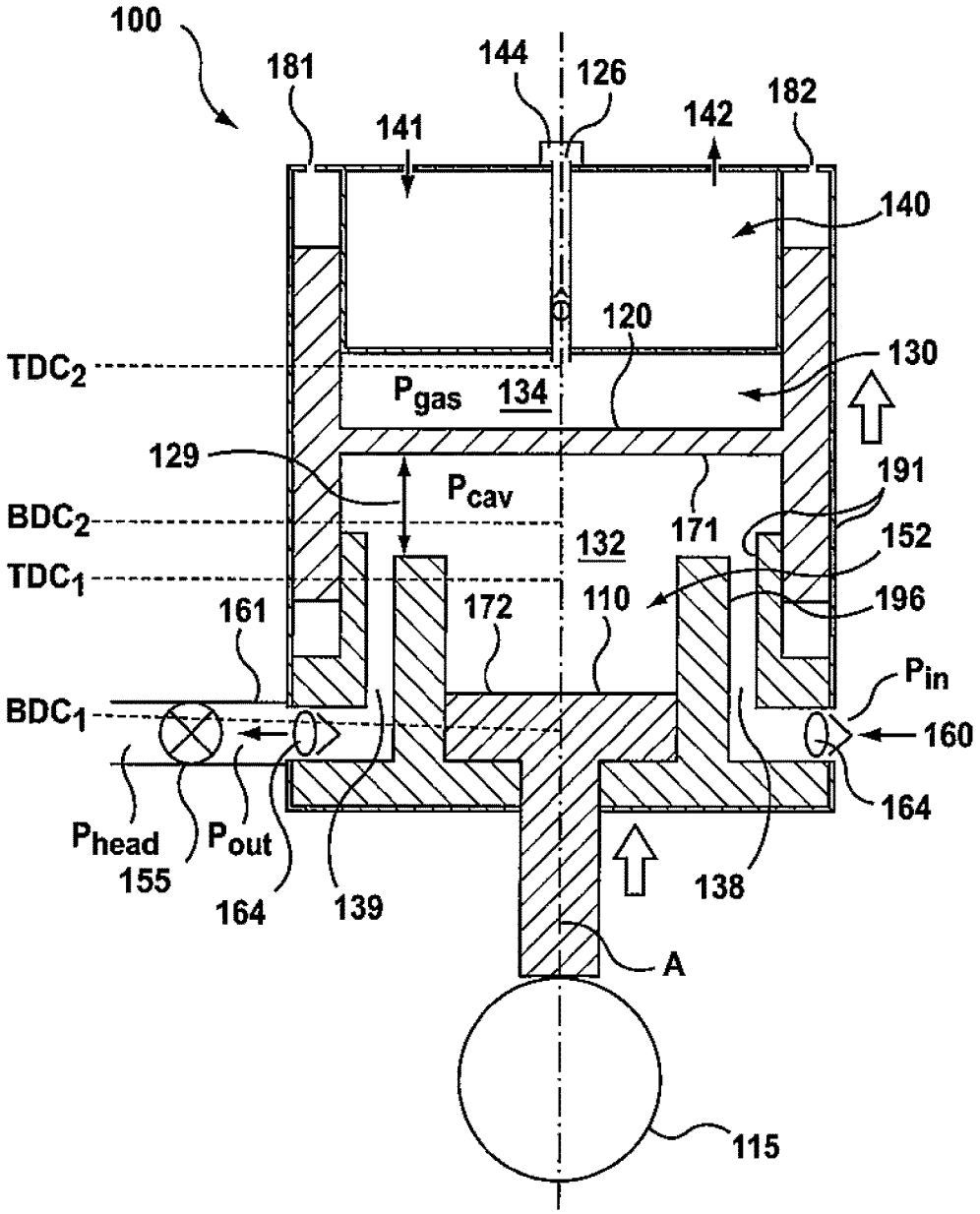
FIGS. 4A to 4C are schematic diagrams showing the non-compressible fluid ejection phase under low injection pressure for one embodiment of the assembled piston unit described herein.
Figure 4B:
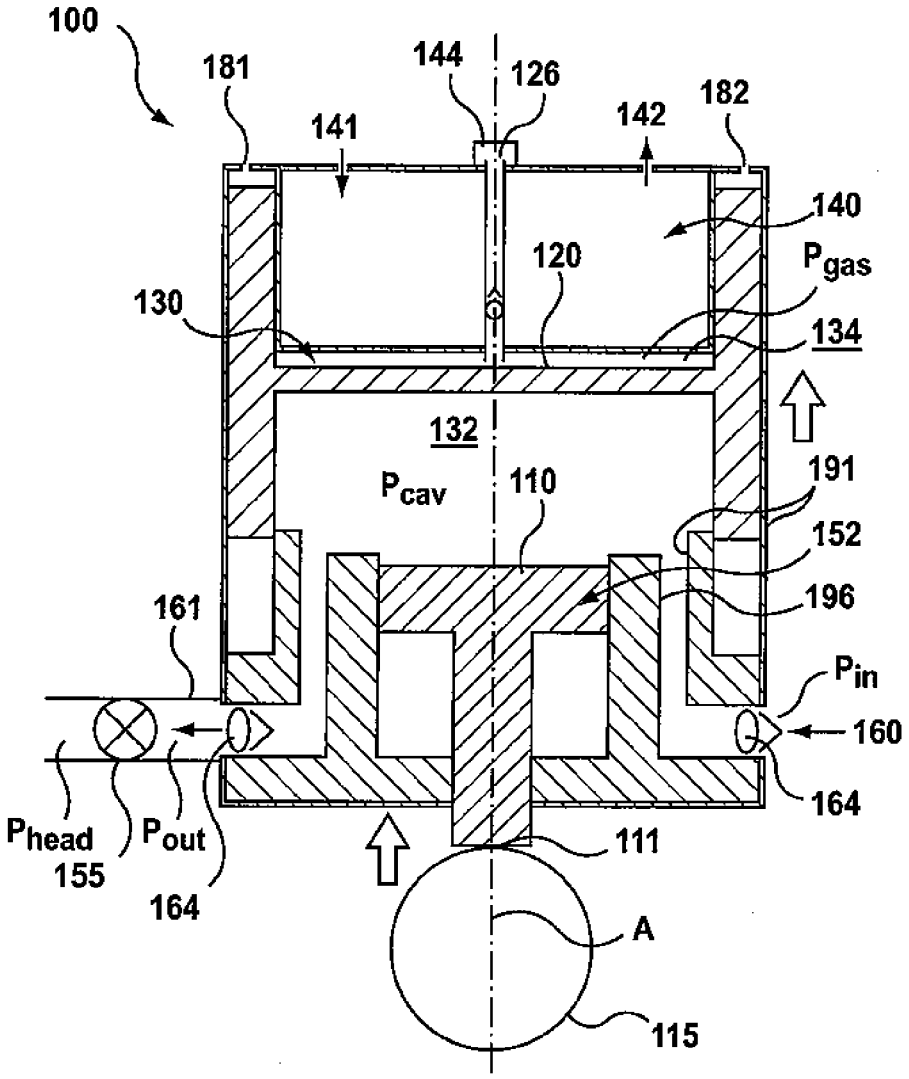

On commencement of the upstroke from BDC, as shown in FIG. 4A, the cam (or other mechanical actuation) 115 drives the primary piston 110 upwards. The piston unit 100 is working into the head pressure of $P_{head}$ of valve 155, the pressures $P_{cav}$, $P_{gas}$ must reach $P_{head}$ before any fluid volume is expelled from the piston unit 100. The fluid located in fluid cavity 132 is pushed upwards towards the secondary piston 120 and the gas in gas cavity 134 as primary piston 110 is actuated by the cam 115. The gas in gas cavity 134 is compressed by the secondary piston 120 as the $P_{cav}$ increases in response to the volume of fluid cavity 132 decreasing as primary piston 110 moves upwards. The primary and secondary pistons 110, 120 move upwards to TDC, shown in FIG. 4B. In this case, the $P_{cav}$ increases towards $P_{head}$, the secondary piston 120 moves upwards in tandem with the primary piston 110 and therefore the volume of the gas cavity 134 decreases. As the primary piston 110 approaches TDC, the non-compressible fluid located within fluid cavity 110 does not reach the required $P_{head}$ to provide for the fluid to pass out of fluid outlet 181 and no ejection of the non-compressible fluid occurs. The pump delivery will be zero and any energy absorbed compressing the gas in gas cavity 134 will be elastically returned on the successive downstroke, thereby no net energy will be absorbed from the pump shaft.

Figure 4C:
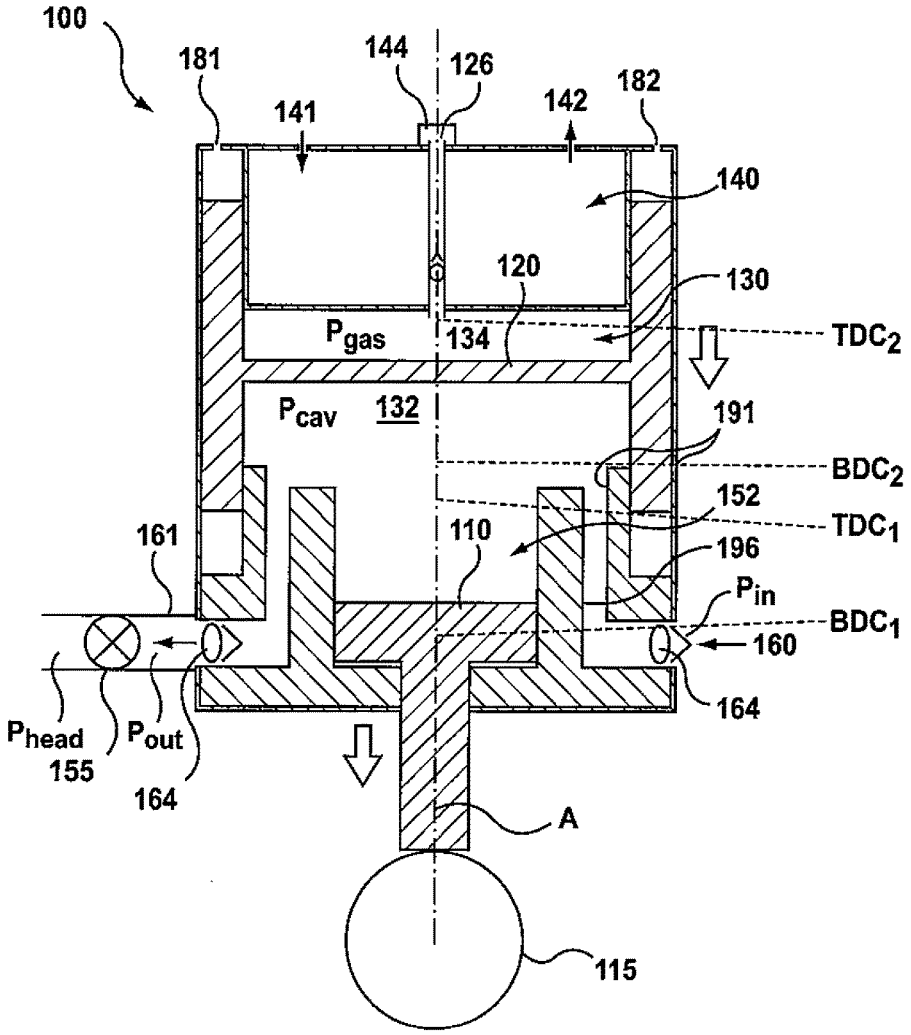

During the ensuing downstroke, shown in FIG. 4C, no new non-compressible fluid is injected into the fluid cavity 132 because the gas in the gas cavity 134 merely re-expands as the primary piston 110 moves away from TDC. In turn, the primary piston 110 moves downward since the force of the mechanical actuation against the piston bottom 112 is reduced (i.e. cam moves away), while the compressed gas in the gas cavity 134 initially at $P_{gas}$ greater than $P_{in}$ simply re-expands to "give back" the original volume in the gas cavity 134, as a consequence of the secondary piston 120 being subjected to non-compressible fluid $P_{in}$. In a low fluid injection mode, the gas volume behaves as a spring-loaded buffer that can "carry over" fluid from one complete stroke of the piston unit 110 to a following stroke while inhibiting vacuum in the non-compressible fluid cavity 132 (i.e. non-compressible fluid is not injected into the fluid cavity on the downstroke, so secondary piston 120 moves from a position near TDC to a position near BDC as the primary piston 110 is travelling towards BDC, due to the expanding gas cavity 134). In this manner, the volume of the gas cavity 134 alternates between a compressed/reduced state when subjected to a non-compressible fluid pressure outlet pressure $P_{out}$ upwards of $P_{head}$ and an expanded state when subjected to a non-compressible fluid pressure $P_{in}$.

It should be noted that the above description of the low pressure injection mode of operation is based on a simplified case of no pre-crush (i.e. decrease in the gas cavity 132 volume during initial injection of the non-compressible fluid via the inlet 160). This is because $P_{in}$ is at or below $P_{gas}$, which does not force any positive pressure differential travel of the secondary piston 120 down into the secondary piston bore 130. However, in practical operation of the piston unit 100, there can be a number of practical resistances in flow of the injected non-compressible fluid that must be overcome, for example calibrated spring resistance of the check valve in the inlet 160, head loses in any fittings/hoses (not shown), and oil viscosity. Further, practical injection timing issues of measured volumes of non-compressible fluid in a timely fashion can provide for the need of higher injection pressures. One example of the practical considerations for higher injection pressures is to provide for a sufficient timely volume of non-compressible fluid in the primary piston bore 152 to encourage continual contact of the piston bottom 112 with the cam 115 during travel of the primary piston 110 from TDC to BDC. For example, gas pressure $P_{gas}$ before any compression of the gas cavity 134 could be as low is 30 PSI. Initial non-compressible fluid injection pressure $P_{in}$ could be say, 100 PSI which is more than 30 PSI for $P_{gas}$.

Non-Compressible Fluid Ejection Phase—High Pressure

In this scenario an initial injection pressure of $P_{in} >> P_{cav}$ is used and the pump is working into a head of $P_{head}$, where $P_{head} >> P_{in}$. As the upward stroke commences, shown in FIG. 5A, and the primary piston 110 moves away from BDC, the gas located in gas cavity 134 is compressed further. However, since the initial $P_{in}$ of injection pressure has already driven the secondary piston to much of its available stroke, it will only require a small additional movement of the secondary piston 120 to raise the pressure to $P_{head}$ which will be sufficient to initiate ejection of the non-compressible fluid from the fluid cavity 132 through the fluid outlet 161 as $P_{gas}$ increases.

Figure 5A:
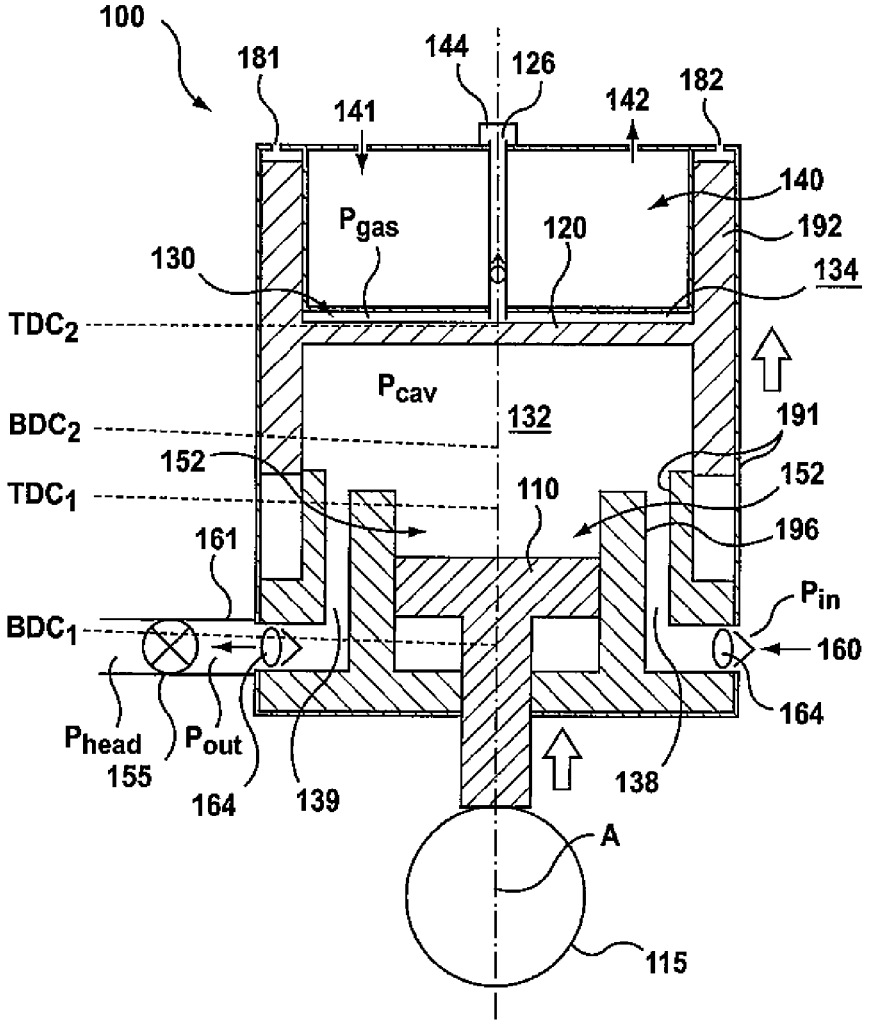
FIGS. 5A to 5C are schematic diagrams showing the non-compressible fluid ejection phase under high injection pressure for one embodiment of the assembled piston unit described herein.
Figure 5B:
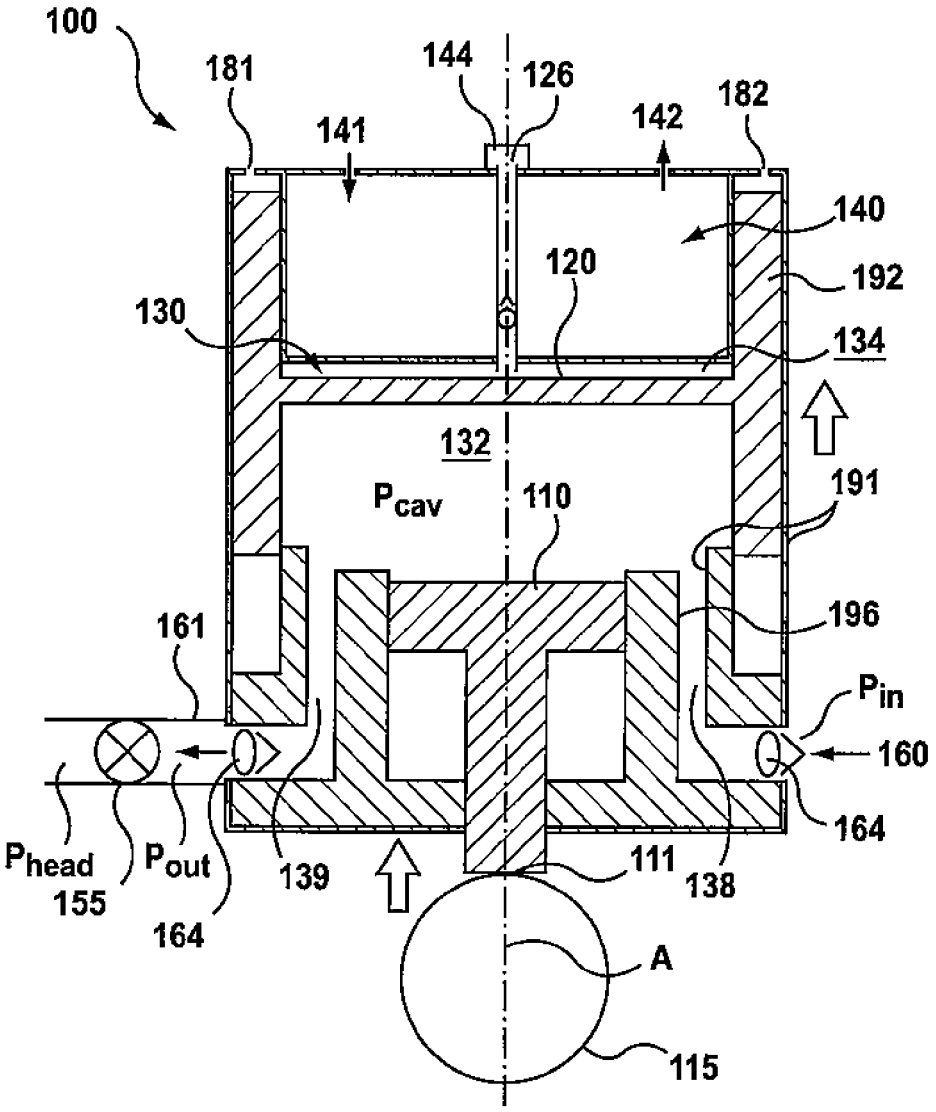

As the primary piston 110 continues to move upward from BDC, the non-compressible fluid is continuously ejected out of the fluid outlet 161 at $P_{head}$. When the primary piston 110 reaches TDC the pump has delivered much of its theoretical displacement. Work has been performed and energy has been absorbed from the pump shaft. FIG. 5B shows the primary piston 110 at TDC.

Figure 5C:
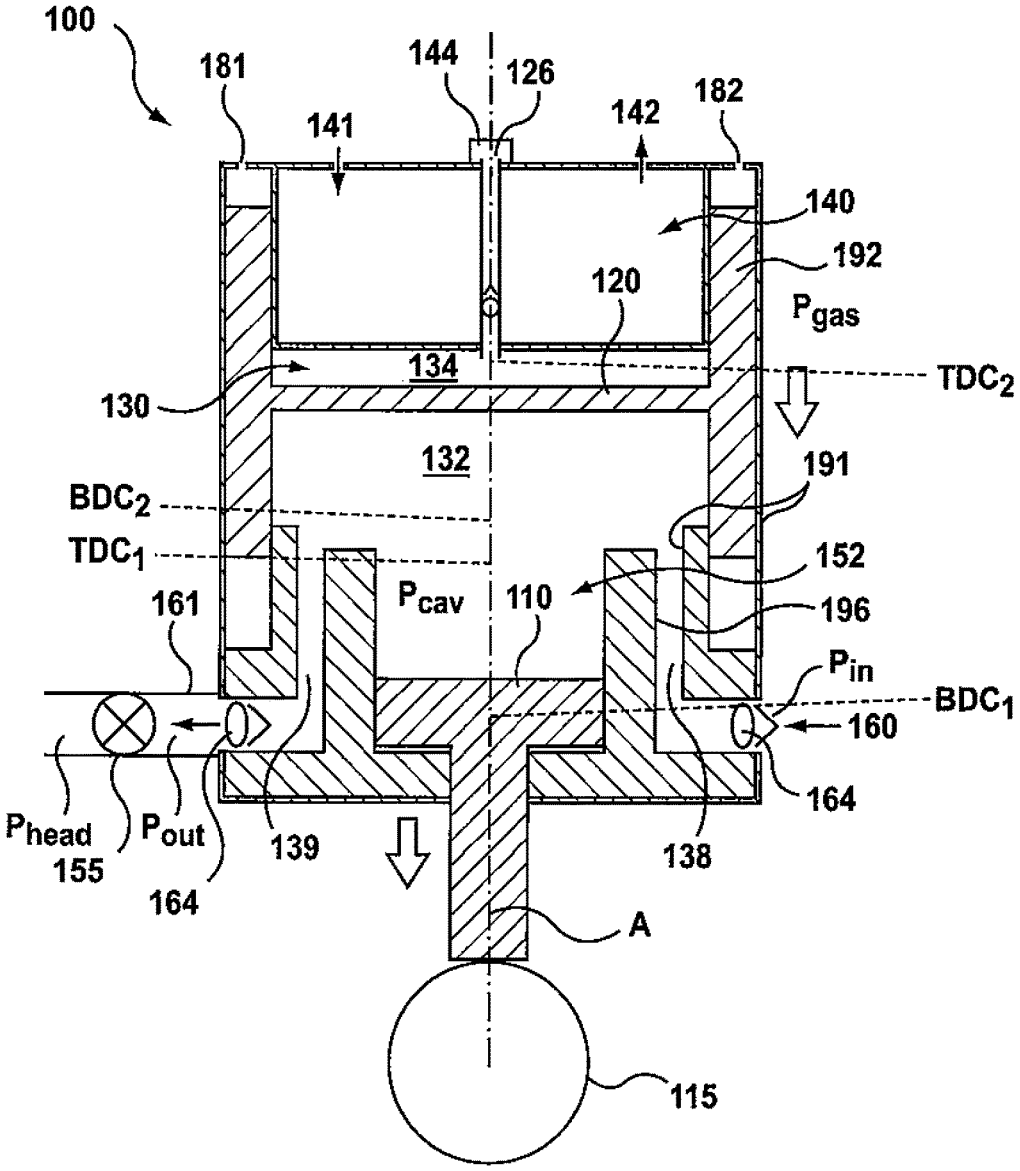

During the ensuing downstroke, shown in FIG. 5C, the gas located in gas cavity 134 re-expands, which drops the pressure of $P_{gas}$ from $P_{head}$ to the initial $P_{in}$ which restores the piston unit 100 to its initial state. Once this differential is absorbed, the secondary piston 120 effectively remains pinned upward at 90% of its stroke due to the continual injection of non-compressible fluid into the fluid cavity 132 at $P_{in}$. As the non-compressible fluid continues to be injected into the fluid cavity 132 and the primary piston 110 continues to travel towards BDC, the volume of the fluid cavity 132 increases allowing more non-compressible fluid to fill it. In this high pressure injection mode, the gas in gas cavity 134 will maintain only small volumetric changes from one rotational cycle to the next.

As can be seen from the description provided above, the piston unit 100, allows for pump flow to be varied from 0 to 100% through modulation of the injection pressure between 15 and 150 PSI, for example. Injection pressure between the two values will result in pump flows roughly proportional to injection pressures. In addition to the flow control, pressure control valves may be used in the non-compressible fluid output that can simultaneously control the pressure head seen by the pump.

It will be understood that the work performed by the brake is the product of flow and working head (PSI). This combined modulation technique easily delivers seamless control with a high (1000:1) turndown ratio which is a requisite for vehicle braking.

Although three modes of operation are described, the piston unit is capable of variable modes of operation based upon the injection pressure applied at the fluid inlet 160. FIGS. 3 to 5 are provided as illustrative examples, however, one of skill in the art would understand that the operation of the piston unit 100 can be transitioned by varying degrees between low and high pressure injection to increase or decrease the compression of the gas cavity 134 to provide variable control of the primary piston 110.

Figure 7A:
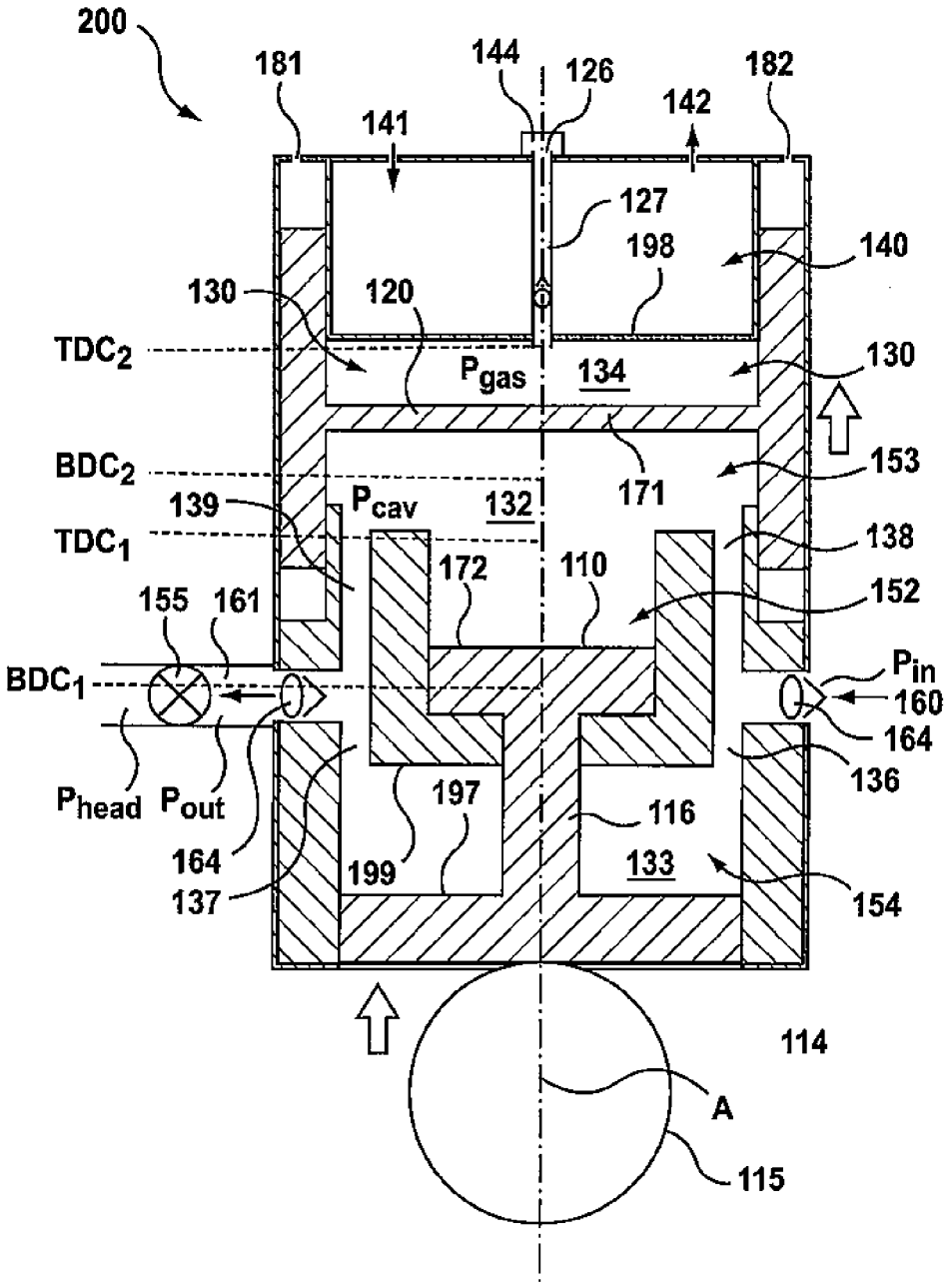
FIGS. 7A to 7C are schematic diagrams showing the non-compressible fluid ejection phase under low injection pressure for a second embodiment of the assembled piston unit described herein.
Figure 7B:
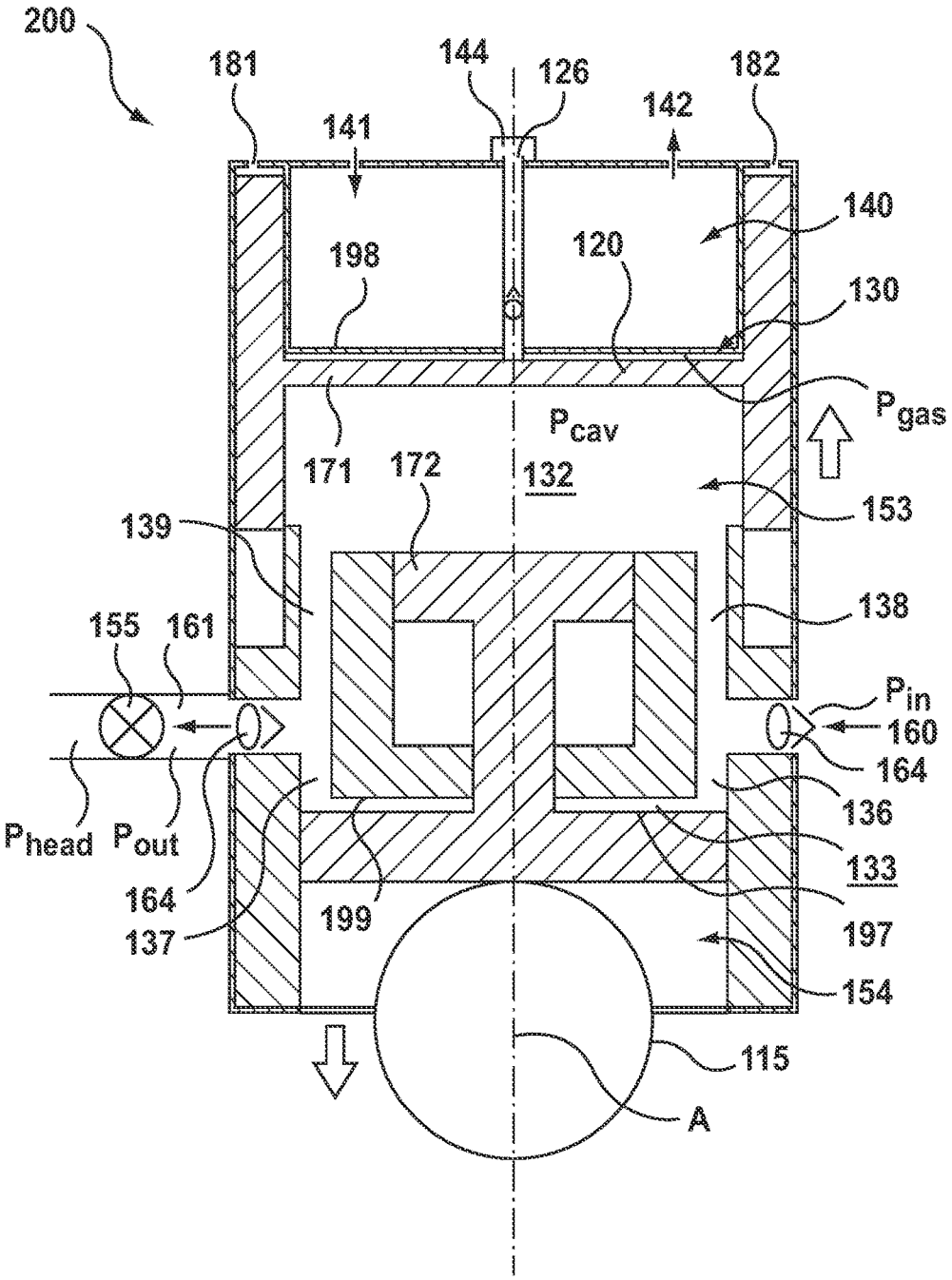
Figure 7C:
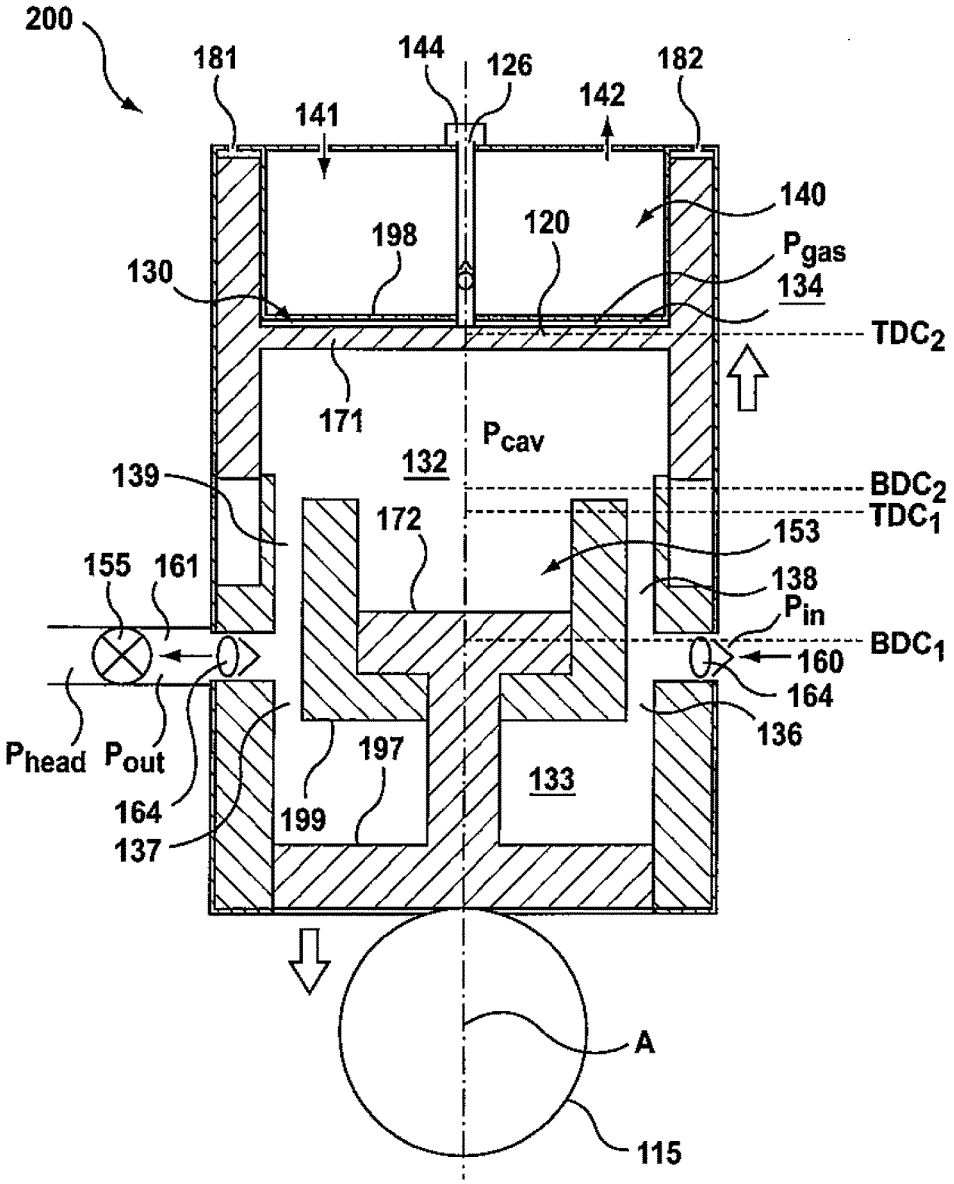
Figure 8A:
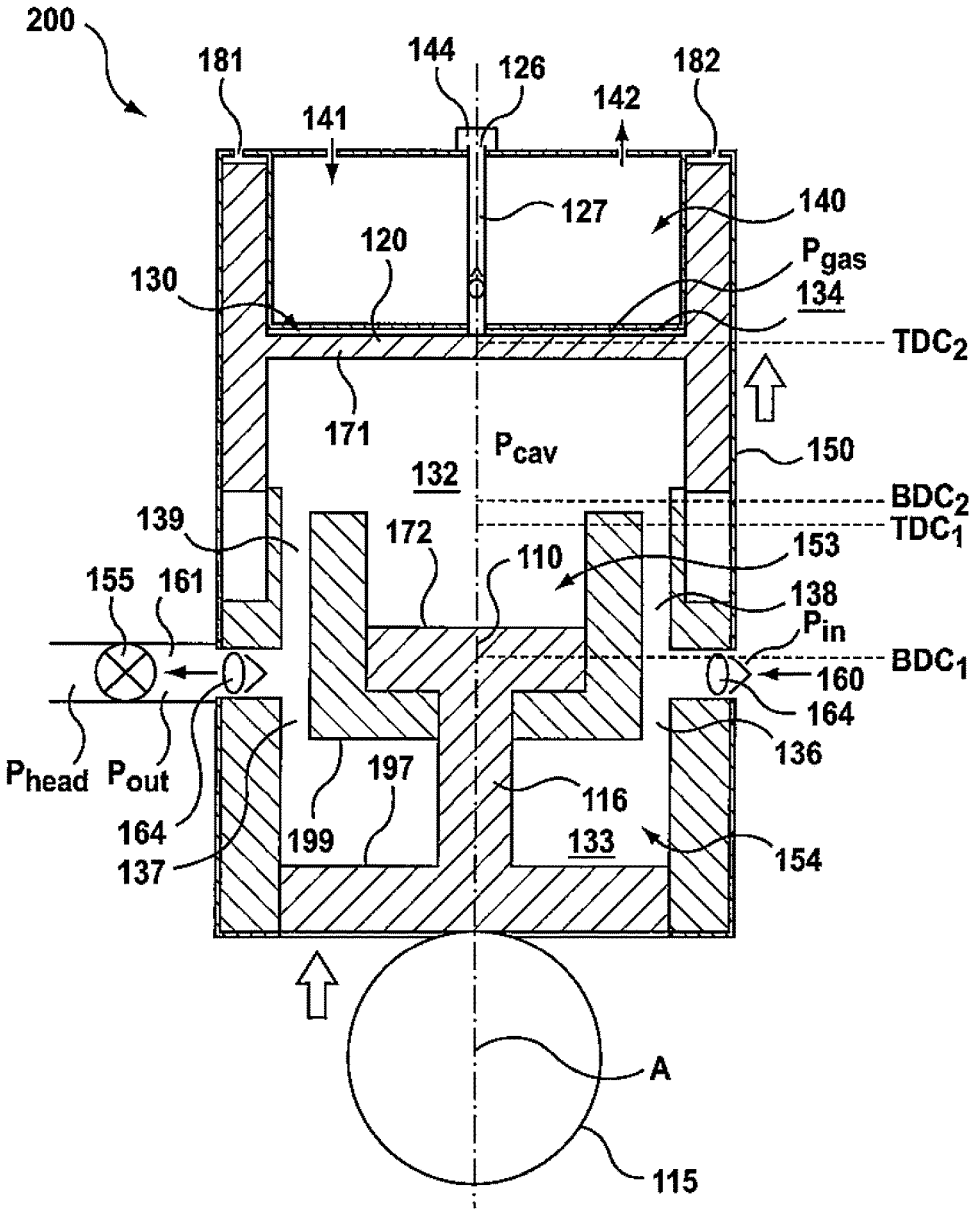
FIGS. 8A to 8C are schematic diagrams showing the non-compressible fluid ejection phase under high injection pressure for a second embodiment of the assembled piston unit described herein.
Figure 8B:
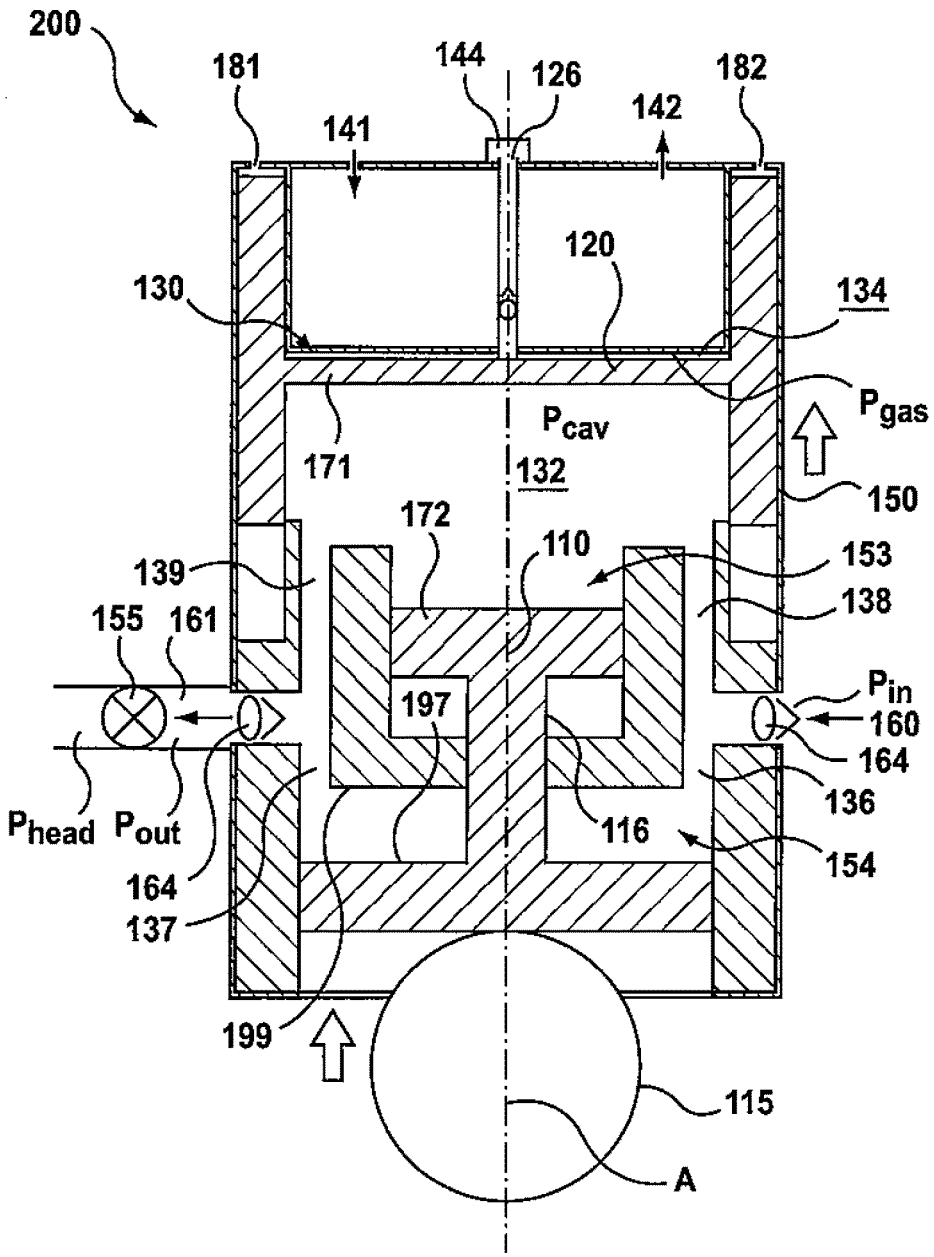

FIGS. 6 to 8 shows the operation of the alternative embodiment described above. Again, three examples of the operation of the piston unit 200 will be described.

Non-Compressible Fluid Injection Phase

In FIG. 6 a non-compressible fluid injection phase is shown. For the purposes of this description an assumption is made that an initial air charge of $P_{gas}$ is provided through the gas inlet stem 124 and is trapped within the gas cavity 134.

Figure 6A:
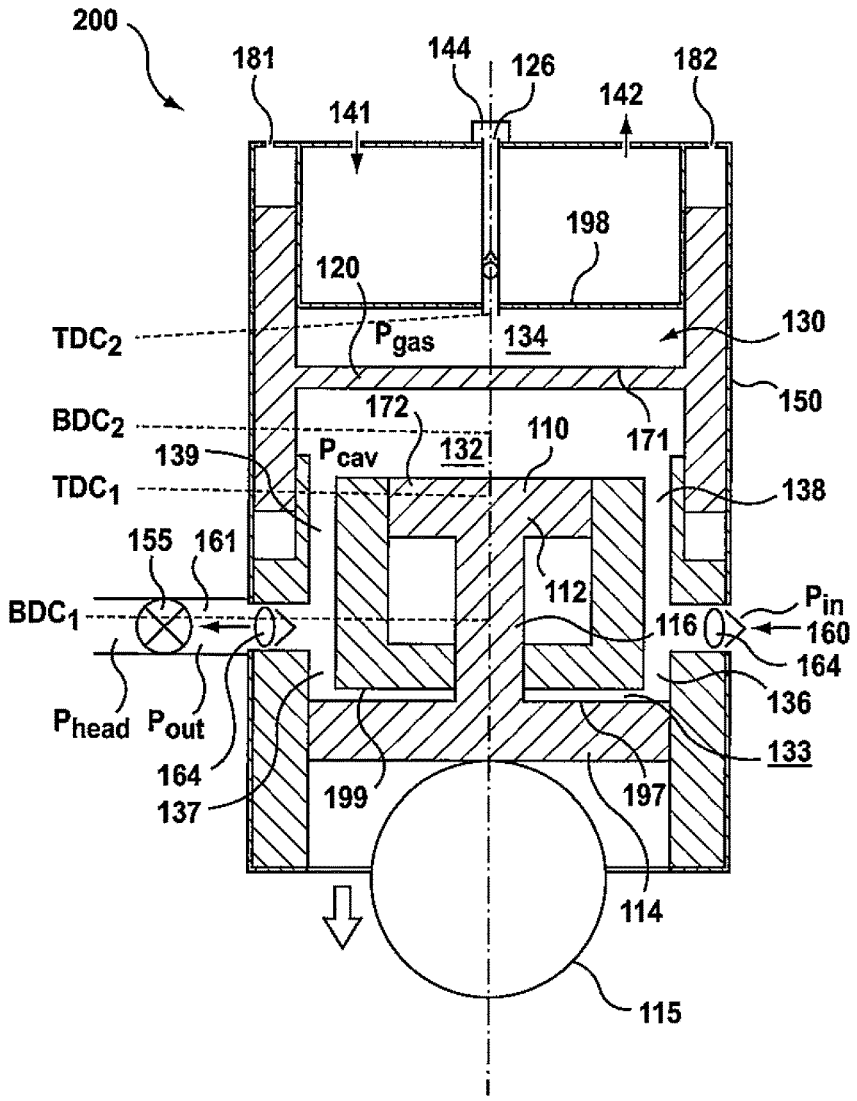
FIGS. 6A to 6C are schematic diagrams showing the non-compressible fluid injection phase for a second embodiment of the assembled piston unit described herein.

As primary piston 110 commences a down-stroke from TDC in response to mechanical actuation by the cam 115, as shown in FIG. 6A, injection pressure opens the fluid inlet 160 and non-compressible fluid is injected through fluid inlet 160. If $P_{in}=P_{gas}$, fluid fills the non-compressible fluid cavities 132 and 133 that is increasing in size due to the receding primary piston 110 without displacing the secondary piston 120 due to the counter balance of the gas (P) in the gas cavity 134.

Figure 6B:
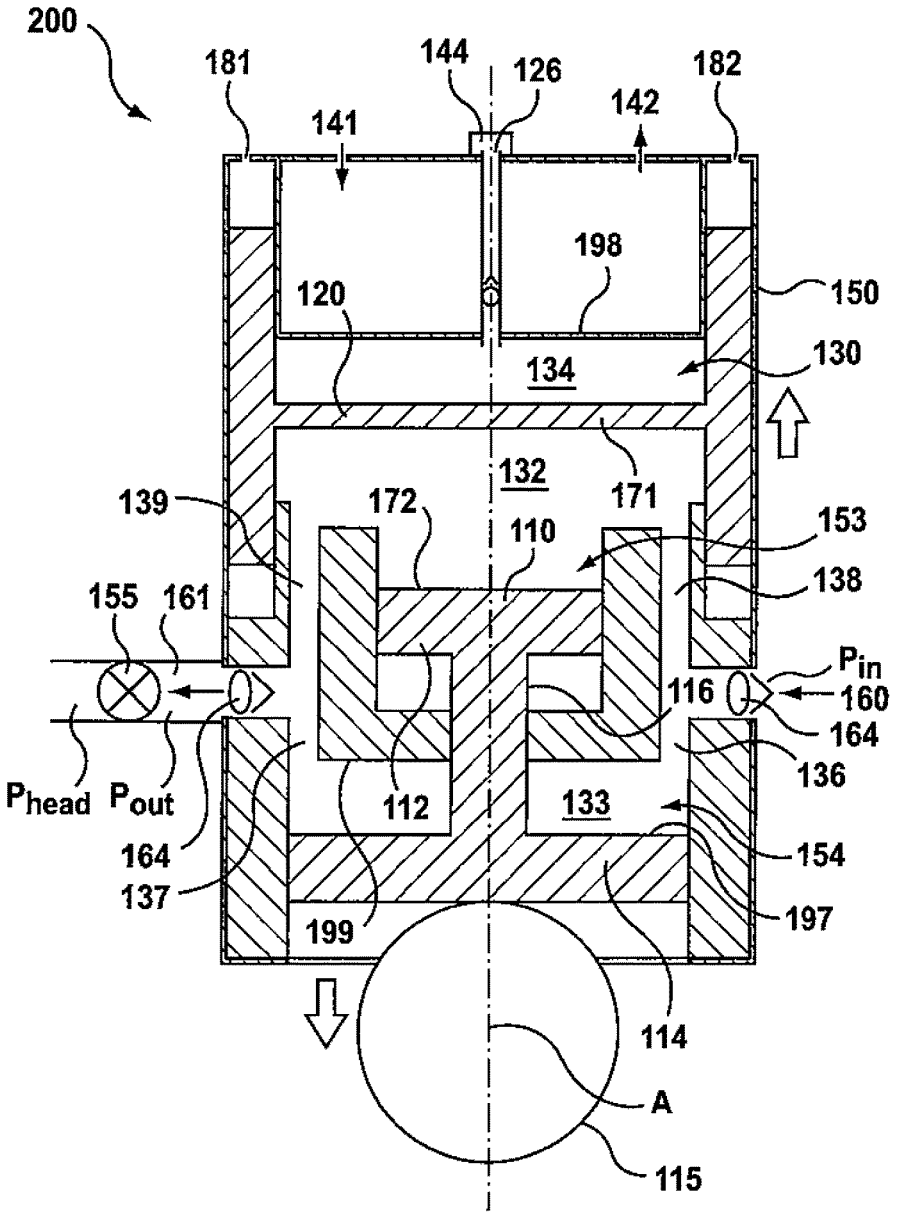

FIG. 6B shows a fluid injection pressure $P_{cav}>P_{gas}$. When non-compressible fluid is injected at this pressure, the pressure in the fluid cavity 132 overcomes $P_{gas}$ and moves the secondary piston 120 upward and away from the primary piston 110, compressing the gas in the gas cavity 134 such that $P_{cav}=P_{gas}$. As the secondary piston 120 moves upward, the primary piston 110 descends within primary piston bore 152 which creates a greater volume in the fluid cavities 132 and 133.

Figure 6C:
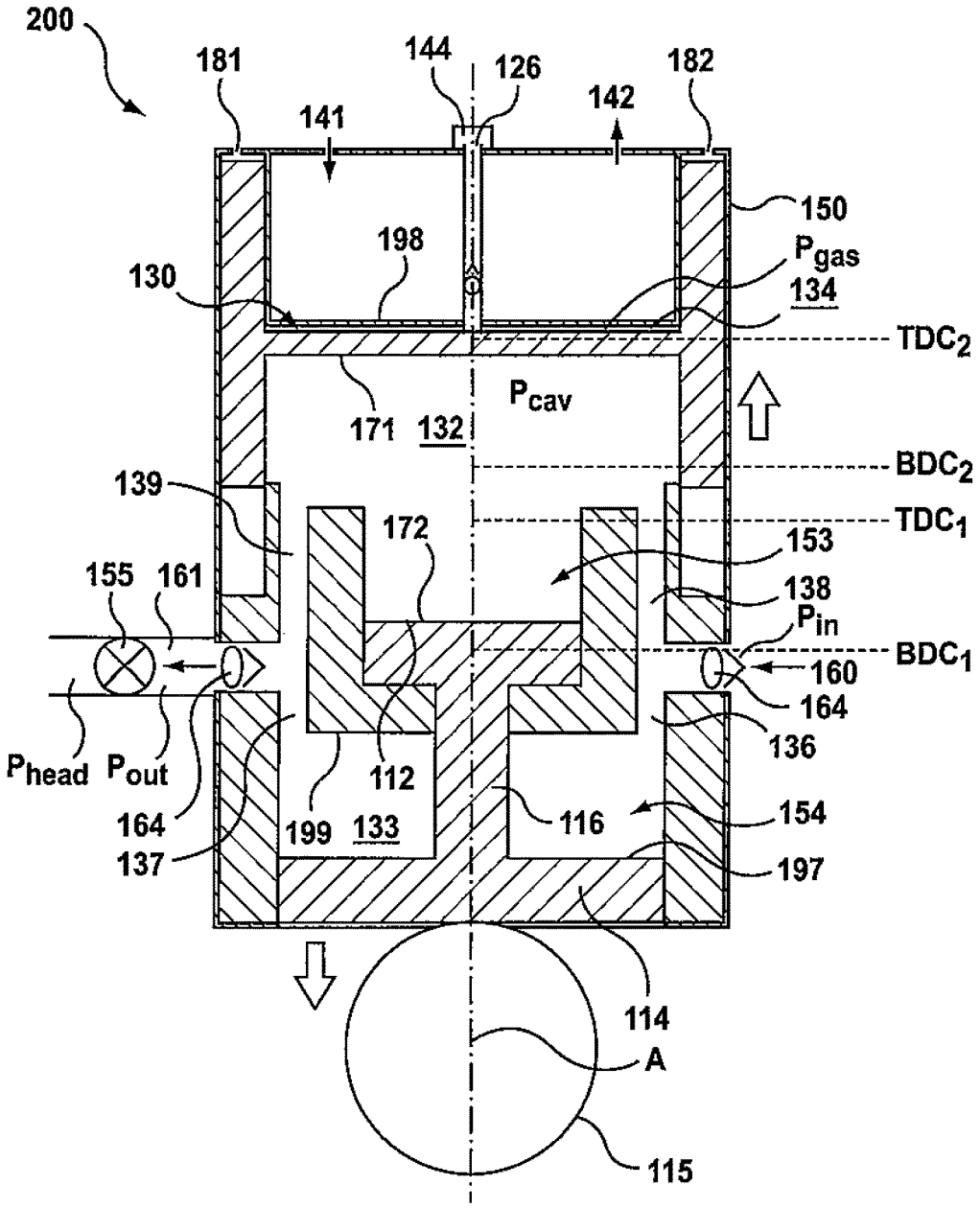

FIG. 6C shows an injection pressure of $P_{cav}>>P_{gas}$. As the non-compressible fluid is injected into fluid cavities 132 and 133, the pressure of the non-compressible fluid moves the secondary piston 120 away from the primary piston 110 towards the end of the secondary piston bore 130, reducing the size of gas cavity 134 and compressing the air further. This allows additional non-compressible fluid to be injected into fluid cavities 132 and 133. When the primary piston 110 reaches BDC, as shown in FIG. 6C, the secondary piston 120 is now at the top of the secondary piston bore 130 and the pressure $P_{cav}$, $P_{gas}$ is still substantially equal on both sides.

As can be seen from FIGS. 6A to 6C the total volume of non-compressible fluid that can be injected into the fluid cavities 132 and 133 is a function of the initial injection pressure. The higher the injection pressure the larger volume of injected non-compressible fluid.

Non-Compressible Fluid Ejection Phase—Low Pressure

On commencement of the upstroke from BDC, as shown in FIG. 7A, the cam (or other mechanical actuation) 115 drives the primary piston 110 upwards. The piston unit 200 is working into the head pressure of $P_{head}$, the pressures $P_{cav}$, $P_{gas}$ must reach this before any fluid volume is expelled from the piston unit 200. The fluid located in fluid cavities 132 and 133 moves upwards towards the secondary piston 120 and the gas in gas cavity 134 is compressed by the secondary piston 120. The primary and secondary pistons 110, 120 move upwards to TDC as shown in FIG. 4A. In this case, the $P_{cav}$ increases towards $P_{head}$, the secondary piston 120 moves upwards in tandem with the primary piston 110 and therefore the volume of the gas cavity 134 decreases. As the primary piston 110 approaches TDC, as shown in FIG. 7B, the non-compressible fluid located within fluid cavity 110 does not reach the required $P_{head}$ to allow for the fluid to pass out of fluid outlet 161 and no ejection of the non-compressible fluid occurs. The pump delivery will be zero and any energy absorbed compressing the gas in gas cavity 134 will be elastically returned on the successive downstroke, thereby no net energy will be absorbed from the pump shaft.

During the ensuing downstroke, shown in FIG. 7C, no new non-compressible fluid is injected into the fluid cavities 132 and 133 because the gas in the gas cavity 134 merely re-expands as the primary piston 110 moves away from TDC. In turn, the primary piston 110 moves downward since the force of the mechanical actuation against the piston bottom 112 is reduced (i.e. cam moves away), while the compressed gas in the gas cavity 134 initially at $P_{gas}$ greater than P simply re-expands to "give back" the original volume in the gas cavity 134, as a consequence of the secondary piston 120 being subjected to non-compressible fluid $P_{in}$ at pressure P. In a low fluid injection mode, the gas volume behaves as a spring-loaded buffer that can "carry over" fluid from one stroke to the next while inhibiting vacuum in the non-compressible fluid cavities 132 and 133 (i.e. non-compressible fluid is not injected into the fluid cavity on the down stroke but the secondary piston 120 remains near TDC as the primary piston 110 is travelling towards BDC due to the expanding gas cavity 134). In this manner, the volume of the gas cavity 134 alternates between a compressed/reduced state when subjected to a non-compressible fluid pressure outlet pressure $P_{out}$ upwards of $P_{head}$ and an expanded state when subjected to a non-compressible fluid pressure $P_{in}$ of P.

It should be noted that the above description of the low pressure injection mode of operation is based on a simplified case of no pre-crush (i.e. decrease in the gas cavity 132 volume during initial injection of the non-compressible fluid via the inlet 160). This is because $P_{in}$ is at or below $P_{gas}$, which does not force via any positive pressure differential travel of the secondary piston 120 down into the secondary piston bore 130. However, in practical operation of the piston unit 100, there can be a number of practical resistances in flow of the injected non-compressible fluid that must be overcome, for example calibrated spring resistance of the check valve in the inlet 160, head loses in any fittings/hoses (not shown), and oil viscosity. Further, practical injection timing issues of measured volumes of non-compressible fluid in a timely fashion can provide for the need of higher injection pressures. One example of the practical considerations for higher injection pressures is to provide for a sufficient timely volume of non-compressible fluid in the primary piston bore 152 to encourage continual contact of the piston bottom 112 with the cam 115 during travel of the primary piston 110 from TDC to BDC. For example, gas pressure $P_{gas}$ before any compression of the gas cavity 134 could be as low is 30 PSI. Initial non-compressible fluid injection pressure $P_{in}$ could be say, 100 PSI which is more than 30 PSI for $P_{gas}$.

Non-Compressible Fluid Ejection Phase—High Pressure

In this scenario an initial injection pressure of $P_{in}>>P_{cav}$ is used and the pump is working into a head of $P_{head}$, where $P_{head}>>P_{in}$. As the upward stroke commences, shown in FIG. 8A, and the primary piston 110 moves away from BDC, the gas located in gas cavity 134 is compressed further. However, since the initial $P_{in}$ of injection pressure has already driven the secondary piston to much of its available stroke, it will only require a small additional piston travel to raise the pressure to $P_{head}$ which will be sufficient to initiate ejection of the non-compressible fluid from the fluid cavities 132 and 133 through the fluid outlet 161.

As the primary piston 110 continues to move upward from BDC, the non-compressible fluid is continuously ejected out of the fluid outlet 161 at $P_{head}$. When the primary piston 110 reaches TDC the pump has delivered approximately 97% of its theoretical displacement. Work has been performed and energy has been absorbed from the pump shaft. FIG. 5B shows the primay piston 110 at TDC.

Figure 8C:
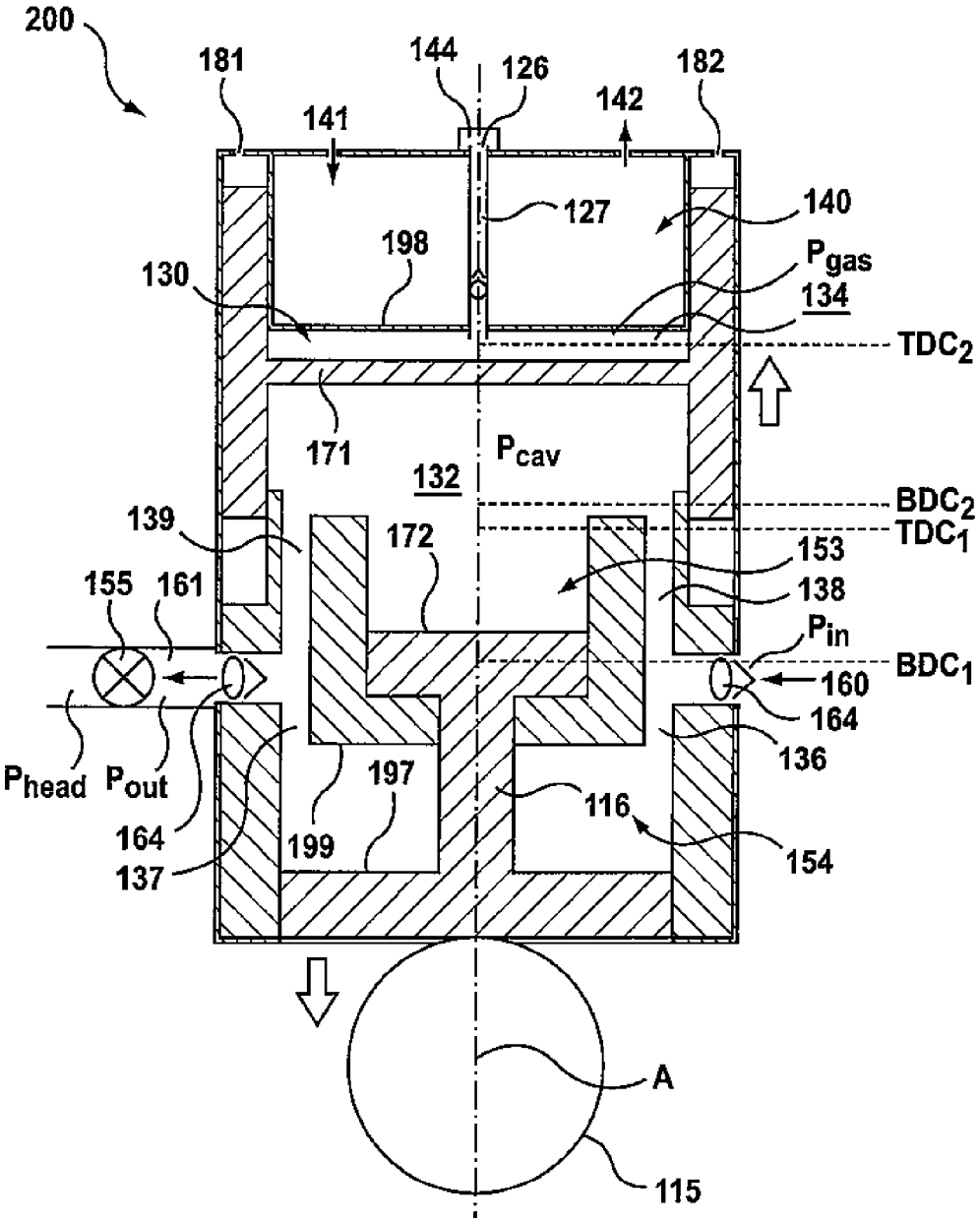

During the ensuing downstroke, shown in FIG. 8C, the gas located in gas cavity 134 re-expands, which drops the pressure from $P_{head}$ to the initial $P_{in}$ which restores the piston unit 100 to its initial state. Once this differential is absorbed, the secondary piston 120 effectively remains pinned upward at 90% of its stroke due to the continual injection of non-compressible fluid into the fluid cavities 132 and 133 at $P_{in}$. As the non-compressible fluid continues to be injected into the fluid cavities 132 and 133 and the primary piston 110 continues to travel towards BDC, the volume of the fluid cavity 132 increases allowing more non-compressible fluid to fill it. In this high pressure injection mode, the gas in gas cavity 134 will maintain only small volumetric changes from one rotational cycle to the next.

As can be seen from the description provided above, the piston unit 200, allows for pump flow to be varied from 0 to 100% through modulation of the injection pressure between 15 and 150 PSI, for example. Injection pressure between the two values will result in pump flows roughly proportional to injection pressures. In addition to the flow control, pressure control valves may be used in the non-compressible fluid output that can simultaneously control the pressure head seen by the pump.

In view of the above, described is a piston unit 100 comprising a main block having a primary piston bore located there-through and having an axis extending lengthwise through the primary piston bore; a primary piston operable to reciprocate within the primary piston bore along the axis; the primary piston bore defining a fluid cavity between a top surface of the primary piston, a bottom surface of a secondary piston and opposing and adjacent surfaces of the primary piston bore; the secondary piston surrounding the primary piston bore in a portion thereof, the secondary piston configured to be received within a secondary piston bore and operable to reciprocate therein along the axis, the secondary piston defining a gas cavity between a bottom surface of a head, a bottom surface of the secondary piston and the opposing and adjacent surfaces of the secondary piston bore; the primary piston and the secondary piston operable to reciprocate along the axis relative to each other such that the primary piston is movable within the primary piston bore and the secondary piston is moveable within the secondary piston bore contrary to the movement of the primary piston; the head for encasing the primary piston and the secondary piston within the main block; and the fluid cavity fluidly connected to a fluid inlet and a fluid outlet for allowing fluid to enter and exit the fluid cavity, the fluid inlet and the fluid outlet positioned between the primary piston bore and the secondary piston bore.

In an alternative embodiment of the piston unit, the piston unit comprises a main block having a secondary piston bore located there-through and having an axis extending lengthwise through the secondary piston bore; a secondary piston operable to reciprocate within the secondary piston bore along the axis; a primary piston configured to be received within the primary piston bore, and operable to reciprocate therein along the axis, the primary piston defining a fluid cavity between a top surface of the primary piston, a bottom surface of the secondary piston and the opposing and adjacent surfaces of the primary piston bore; the primary piston and the secondary piston operable to reciprocate along the axis relative to each other such that the primary piston is movable within the primary piston bore and the secondary piston is moveable within the secondary piston bore contrary to the movement of the primary piston; and the fluid cavity fluidly connected to a fluid inlet and a fluid outlet for allowing fluid to enter and exit the fluid cavity, the fluid inlet and the fluid outlet positioned between the primary piston bore and the secondary piston bore.

It will be understood that the work performed by the brake is the product of flow and working head (PSI). This combined modulation technique easily delivers seamless control with a high (1000:1) turndown ratio which is a requisite for vehicle braking.

Although three modes of operation are described, the piston unit is capable of variable modes of operation based upon the injection pressure applied at the fluid inlet 160. FIGS. 6 to 8 are provided as illustrative examples, however, one of skill in the art would understand that the operation of the piston unit 100 can be transitioned by varying degrees between low and high pressure injection to increase or decrease the compression of the gas cavity 134 to provide variable control of the primary piston 110.

It will be apparent to one skilled in the art that numerous modifications and departures from the specific embodiments described herein can be made without departing from the spirit and scope of the present disclosure.

I claim:

1. A piston unit comprising:

a main block having a primary piston bore located there-through and having an axis extending lengthwise through the primary piston bore;

a primary piston operable to reciprocate within the primary piston bore along the axis;

the primary piston bore defining a fluid cavity between a top surface of the primary piston, a bottom surface of a secondary piston and opposing and adjacent surfaces of the primary piston bore;

the secondary piston configured to be received within a secondary piston bore and operable to reciprocate therein along the axis, the secondary piston defining a gas cavity between a bottom surface of a head, a top surface of the secondary piston and opposing and adjacent surfaces of the secondary piston bore, the secondary piston bore overlapping the primary piston bore in a portion thereof;

the primary piston and the secondary piston operable to reciprocate along the axis relative to each other such that the primary piston is movable within the primary piston bore and the secondary piston is moveable within the secondary piston bore contrary to the movement of the primary piston;

the head for encasing the primary piston and the secondary piston within the main block; and the fluid cavity fluidly connected to a fluid inlet and a fluid outlet for allowing fluid to enter and exit the fluid cavity, the fluid inlet and the fluid outlet positioned between a side wall of the primary piston bore and a side wall of the secondary piston bore at said portion of said the secondary piston bore overlapping the primary piston bore.

2. The piston unit of claim 1, wherein said overlapping defines a piston-in-piston configuration.

3. The piston unit of claim 2, wherein the fluid inlet and fluid outlet each comprise a one way valve.

4. The piston unit of claim 1, wherein the secondary piston moves within the secondary piston bore relative to pressure of fluid injected into the fluid cavity.

5. The piston unit of claim 1, wherein the movement of the primary piston is relative to the movement of an external surface abutting a lower surface of the primary piston.

6. The piston unit of claim 1, wherein the movement of the primary piston is relative to the movement of an axle, the primary piston moving in relation to a mechanical actuator coupled to the axle.

7. The piston unit of claim 1, wherein the primary piston further comprises a piston bottom on a bottom surface thereof.

8. The piston unit of claim 1, wherein at least one of the primary piston and the secondary piston are non-concentric about the axis.

9. A piston unit comprising:

a main block having a secondary piston bore located there-through and having an axis extending lengthwise through the secondary piston bore;

a secondary piston operable to reciprocate within the secondary piston bore along the axis;

a primary piston configured to be received within a primary piston bore, and operable to reciprocate therein along the axis, the primary piston comprising a upper piston portion and a lower piston portion configured to reciprocate along the axis, the upper piston portion and the lower piston portion fixed relative to one another by the length along the axis of a piston stem, the upper portion of the primary piston defining a first fluid cavity between opposed and adjacent surfaces of the primary piston bore, a lower surface of a planar portion of the secondary piston and an upper surface of the upper piston portion of the primary piston the lower portion of the primary piston defining a second fluid cavity between an upper surface of the lower piston portion, opposed and opposite surfaces of a lower primary piston bore and an upper surface of the lower primary piston bore;

the primary piston and the secondary piston operable to reciprocate along the axis relative to each other such that the primary piston is movable within the primary piston bore and the secondary piston is moveable within the secondary piston bore contrary to the movement of the primary piston; and the first and second fluid cavities fluidly connected to a fluid inlet and a fluid outlet for allowing fluid to enter and exit the fluid cavities, the fluid inlet and the fluid outlet positioned between the primary piston bore and the secondary piston bore at a portion of the secondary piston bore overlapping the primary piston bore.

* * * * *